US006341570B2

(12) United States Patent
Fujiwara et al.

(10) Patent No.: US 6,341,570 B2
(45) Date of Patent: Jan. 29, 2002

(54) METHOD AND APPARATUS FOR SEWING THE TOE OF A SOCK

(75) Inventors: Toshifumi Fujiwara, Kashiba; Takeshi Nakahira, Yamototakada; Takahiro Ueda, Yamatotakada; Yusuke Shibata, Yamatotakada, all of (JP)

(73) Assignee: Maruzen Sangyo Co., Ltd., Nara (JP)

( * ) Notice: Subject to any disclaimer, the term of this patent is extended or adjusted under 35 U.S.C. 154(b) by 0 days.

(21) Appl. No.: 09/822,201

(22) Filed: Apr. 2, 2001

(30) Foreign Application Priority Data

May 12, 2000 (JP) ..... 2000-139839

(51) Int. Cl.[7] ..... D05B 33/00; D05B 21/00

(52) U.S. Cl. ..... 112/475.12; 112/470.08; 112/475.07

(58) Field of Search ..... 112/475.12, 470.08, 112/470.06, 470.07, 470.14, 470.15, 475.04, 475.05, 475.07

(56) References Cited

U.S. PATENT DOCUMENTS 5,165,355 A * 11/1992 Fournier et al. .... 112/475.12 X 6,158,367 A * 12/2000 Jordan et al. ..... 112/470.08

* cited by examiner

*Primary Examiner*—Peter Nerbun

(74) *Attorney, Agent, or Firm*—Wenderoth, Lind & Ponack, L.L.P.

(57) ABSTRACT

A method of sewing the toe of a sock is provided which can automatically take out a sock pattern of knitted fabric from a sock knitting machine and sew up the selvedge at the toe portion of the sock pattern of knitted fabric thus improving both the efficiency of production and the energy saving. When a sock pattern of knitted fabric has been fabricated by the sock knitting machine, the transfer needles mounted on a group of transfer needles equipped movable tables are advanced at their tips close to the hooks of knitting needles. Then, the sock pattern of knitted fabric is lifted up and turned inside out by suction to transfer its loops at the toe portion from the knitting needles to the corresponding transfer needles. As a result, the sock pattern of knitted fabric turned inside out is transferred from the sock knitting machine to the transfer needles equipped movable tables. The transfer needles equipped movable tables are then shifted to a linear position to sandwich the loops at the toe portion of the sock pattern of knitted fabric flatly between two rows. The transfer needles equipped movable tables are then conveyed to a toe sewing location where the loops at the toe portion of the sock pattern is sewed up automatically with a sewing machine.

4 Claims, 32 Drawing Sheets

(A)

(B)

(A)

(B)

(C)

(A)

(B)

METHOD AND APPARATUS FOR SEWING THE TOE OF A SOCK

BACKGROUND OF THE INVENTION

1. Field of the Invention

The present invention relates to a method and apparatus for automatically sewing the toe of a sock when having automatically taken out a sock pattern of knitted fabric from a socks knitting machine which knitted the pattern to the toe portion.

2. Description of the Related Art

A common method of fabricating a sock is carried out with the use of a socks knitting machine, such as a circular knitting machine or a tubular knitting machine as comprising the steps of knitting a sock pattern of knitted fabric from ribbed top to a body, a heel, a foot, and a toe and sewing up the toe selvedge.

The step of sewing up the toe selvedge includes removing a sock pattern of knitted fabric from the socks knitting machine, turning the sock pattern inside out, and manually sewing up the toe selvedge with a seam sewing machine.

As the sock pattern of knitted fabric has to be removed from the socks knitting machine, transferred to a station for sewing up the toe selvedge, turned inside out, placed on the seam sewing machine, and sewed up by manual actions of the toe selvedge sewing up step, the production of socks may decline in efficiency thus increasing the overall cost.

It is hence an object of the present invention to provide a method and apparatus for automatically turning inside out and removing a sock pattern of knitted fabric from a socks knitting machine and sewing up its toe selvedge thus to increase the efficiency of socks production and improve the energy saving, hence minimizing the overall production cost.

SUMMARY OF THE INVENTION

For achievement of the object, a method of sewing the toe of a sock defined in claim 1 of the present invention is provided comprising the steps of: after knitting a sock pattern with a sock knitting machine, holding the knitting needles at a specific height, downwardly removing the loops at the toe portion of the sock pattern of knitted fabric from latches of the corresponding knitting needles, and holding the loops at a specific location; positioning a group of transfer needles equipped movable tables in a circular relationship just above the sock knitting machine; setting the transfer needles on the transfer needles equipped movable tables close to the hooks of the knitting needles; lifting up the sock pattern of knitted fabric to turn inside out and transfer the sock pattern at the loops of the toe portion from the knitting needles to the corresponding transfer needles with the help of a transfer bit elevated so that the sock pattern of knitted fabric turned inside out are transferred from the sock knitting machine to the transfer needles equipped movable tables; positioning the transfer needles equipped movable tables in two linear rows aligned opposite to each other to sandwich the toe portion of the sock pattern of knitted fabric flatly from both sides; shifting the transfer needles equipped movable tables to a toe sewing location; and automatically sewing up the toe portion of the sock pattern of knitted fabric with a sewing machine provided at the toe sewing location.

According to claim 2 of the present invention, the method of sewing the toe of a sock defined in claim 1 may be modified further comprising, when the sock pattern of knitted fabric are held by the transfer needles at the toe sewing location, lifting up the sock pattern of knitted fabric with a lifting member to enlarge its loops at the toe portion, inserting a plurality of point needles, each having a recess provided on the upper side thereof, into the corresponding loops which are enlarged, removing the lifting bit from the transfer needles, and sewing up the loops at the toe portion with a sewing needles which performs an intermittent reciprocal action in and along the recess of each point needles.

An apparatus for sewing the toe of a sock defined in claim 3 of the present invention is provided comprising: a group of transfer needles equipped movable tables arranged movable for shifting between a circular position and a linear position where two linear rows come opposite to each other, moving up and down just above a sock knitting machine, and traveling forward and backward horizontally of the sock knitting machine; a plurality of transfer needles mounted on the transfer needles equipped movable tables for radial movement when the transfer needles equipped movable tables are arranged in the circular position; a guide ring for moving up and down in the center of a circle of the transfer needles equipped movable tables arranged in the circular position and when the transfer needles are advanced inwardly, holding the tips of the transfer needles in a circle so that the transfer needles come close to the hooks of the corresponding knitting needles of the sock knitting machine; a vacuum pipe for moving up and down in the guide ring and when held at the lower position, drawing by suction from above the sock pattern of knitted fabric fabricated by the sock knitting machine so that the sock pattern is turned inside out and lifted up; and a sewing machine installed at a location on the horizontal traveling of the transfer needles equipped movable tables for sewing up the toe portion of the sock pattern.

According to claim 4 of the present invention, the apparatus for sewing the toe of a sock defined in claim 3 may be modified further comprising: a lifting member for lifting up the sock pattern of knitted fabric held on the transfer needles at the location for sewing up the toe portion of the sock pattern; a plurality of point needles, each point needle having a recess provided in the upper side thereof, for moving to and from the corresponding loops of the sock pattern of knitted fabric held on the transfer needles; and a sewing needle for performing an intermittent reciprocal action in and along the recess of each point needles which holds one of the loops so that the loops at the toe portion of the sock pattern of knitted fabric can be sewed up.

The transfer needles mounted on the transfer needles equipped movable tables are identical in the number to the knitting needles of the sock knitting machine. The guide ring has the same number of grooves provided in the outer side thereof for accepting and positioning the tips of the transfer needles.

The transfer needles equipped movable table comprises an upper block and a lower holder of a rectangular shape. The holder has a group of grooves provided therein in which the transfer needles are movably mounted. The transfer needles equipped movable table can be driven via a cam member by an air cylinder.

DETAILED DESCRIPTION OF THE PREFERRED EMBODIMENTS

Figure 1:
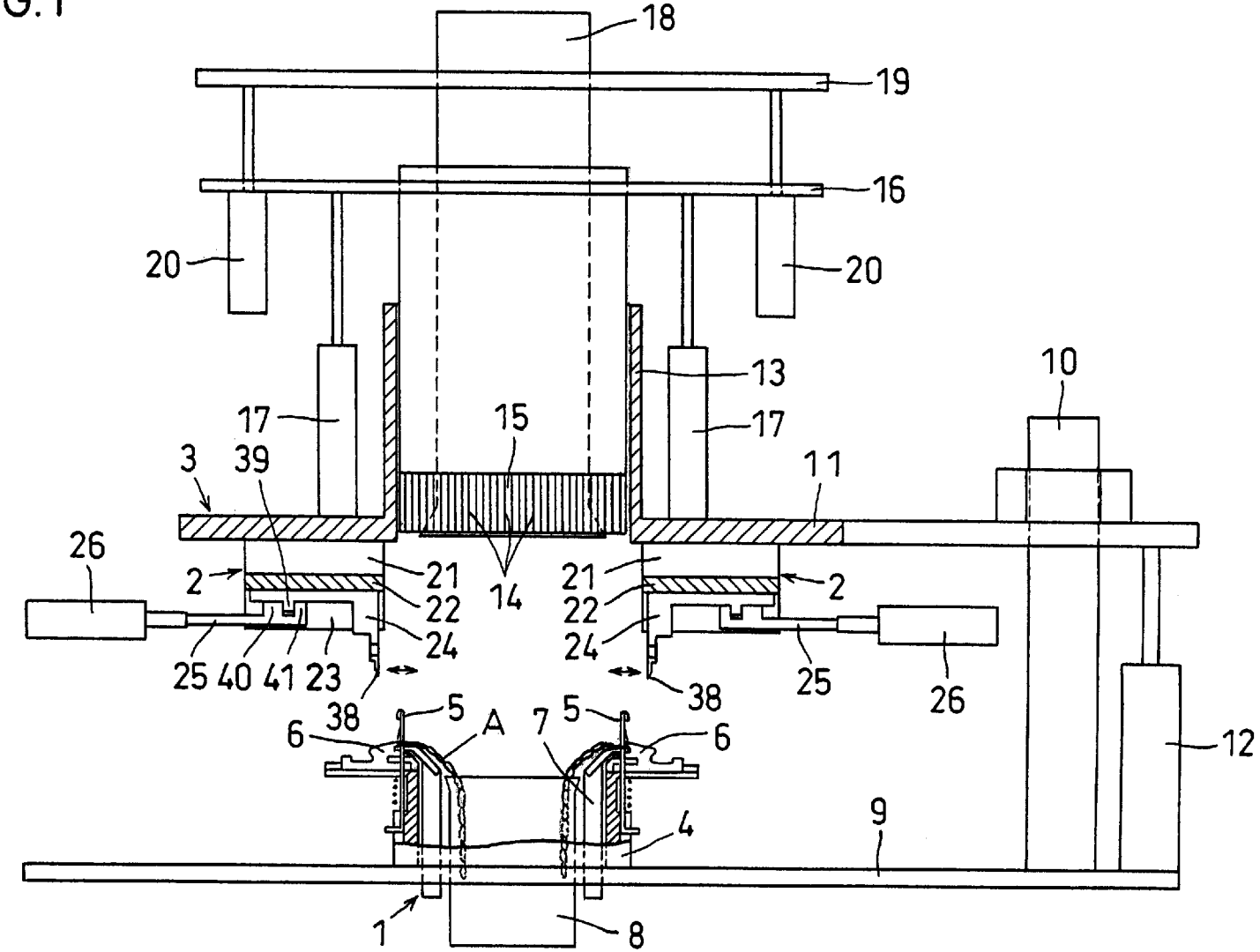
FIG. 1 is a longitudinally cross sectional view showing a sock transfer mechanism and a sock knitting machine with a sock pattern of knitted fabric held thereon at the initial stage according to the present invention.

Some embodiments of the present invention will be described referring to the relevant drawings.

As shown in FIGS. 1 to 15, an apparatus for knitting the toe of a sock comprises a sock knitting machine 1, such as a circular knitting machine or a tubular knitting machine, for knitting a sock pattern of knitted fabric, a sock transfer mechanism 3 having a plurality of transfer needles equipped movable tables 2 arranged for shifting between a circular position and a linear position where their two rows are aligned opposite to each other, lifting upward and downward above the sock knitting machine 1, and traveling in the horizontal direction to the sock knitting machine 1 so that the sock pattern of knitted fabric, denoted by A, fabricated by the sock knitting machine 1 can automatically be removed from the sock knitting machine 1 and transferred horizontally to another stage, and a sewing machine for sewing up the selvedge of the sock pattern of knitted fabric A received from the sock transfer mechanism 3.

The sock knitting machine 1 comprises, as shown in FIGS. 1 to 22, a rotatable circular cylinder 4, a multiplicity of knitting needles 5 supported in a recess provided in the outer side of the cylinder 4 for upward and downward movements to knit the sock pattern of knitted fabric A, a multiplicity of sinkers 6 mounted on a sinker bed of the cylinder 4 for producing stitches with the knitting needles 5, a multiplicity of bits 7 mounted on the inner side of the cylinder 4 for removing the stitches from the fingers of the sinkers 6 and transferring the loops on the knitting needles 5 to the transfer needles described later, and a vacuum pipe 8 mounted in the cylinder 4 for suctioning and lifting down the sock pattern of knitted fabric A by the action of vacuum. In action, as the knitting needles 5 are lifted up and down by the actions of cams not shown with the cylinder 4 rotating, the sock pattern of knitted fabric A can be knitted from a ribbed top to a body, a heel, a foot, and a toe.

The sock transfer mechanism 3 has a support post 10 mounted upright on a base plate 9 as spaced from the sock knitting machine 1. A base plate 11 is mounted horizontally to the support post 10 for rotation about and upward and downward movement along the support post 10. The upward and downward movement of the base plate 11 is activated by an air cylinder 12 mounted between the base plate 11 and the base plate 9. A tubular member 13 of which the inner diameter is substantially equal to the outer diameter of the cylinder 4 is mounted on the base plate 11 so that it comes just above and coaxial with the sock knitting machine 1 when the base plate 11 is shifted to the location above the sock knitting machine 1.

A guide ring 15 having a multiplicity of grooves 14 provided in the outer side thereof is fitted in the tubular member 13 for upward and downward movement. The upward and downward movement of the guide ring 15 is activated by an air cylinder 17 mounted between the base plate 11 and a lifting plate 16 fixedly joined to the top of the air cylinder 17. A vacuum pipe 18 is provided movable upward and downward in the guide ring 15 for suction and lifting of the sock pattern of knitted fabric A fabricated by the sock knitting machine 1. The upward and downward movement of the vacuum pipe 18 is synchronized with that of the guide ring 15. Also, the vacuum pipe 18 can independently be lifted upward and downward by the action of a cylinder 20 mounted between the lifting plate 16 of the guide ring 15 and a lifting plate 19 joined to the top of the cylinder 20.

Provided beneath the base plate 11 are the transfer needles equipped movable tables 2 which can be shifted between the circular position and the linear position where two rows are aligned opposite to each other just below the axis of the tubular member 13.

Each of the transfer needles equipped movable tables 2 comprises an upper block 21 and a lower holder 22 of a rectangular shape. A group of grooves 23 are provided in the holder 22 so that they extend radially when arranged in the circular position. A transfer needle 24 and a cam member are movably mounted in each groove 23. A group of the transfer needles 24 can be moved together via the cam members 25 by the action of an air cylinder 26.

FIGS. 16 to 21 illustrate an arrangement of the transfer needles equipped movable tables 2. In the arrangement shown, eight of the transfer needles equipped movable tables denoted by 2*a* to 2*h* are arranged at equal intervals in the circular position. In the linear position, two rows of the four movable tables 2 are aligned opposite to each other.

Figure 21:
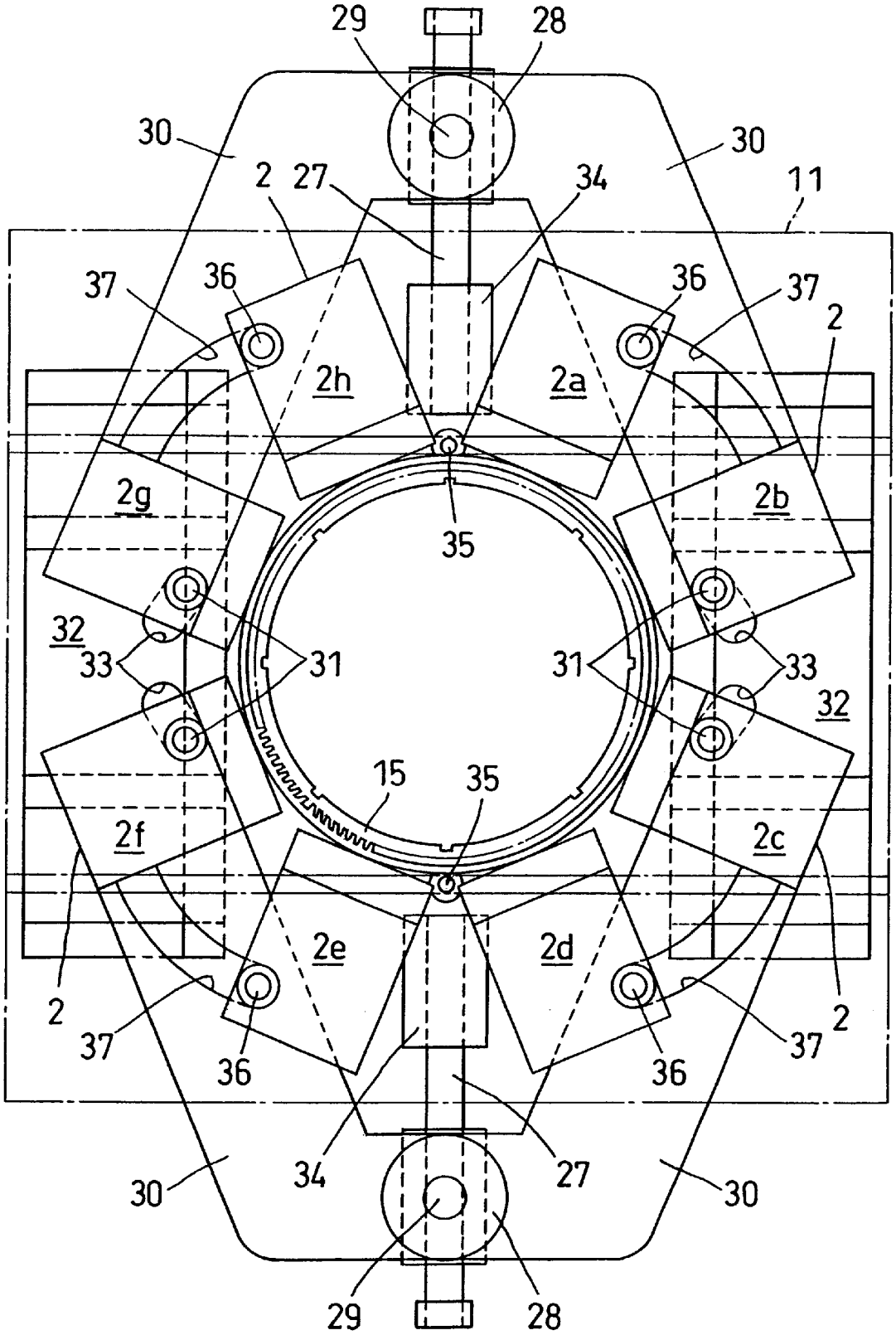
FIG. 21 is an enlarged plan view showing an arrangement of the sock transfer mechanism for shifting the position of the transfer needles equipped movable tables.
Figure 22:
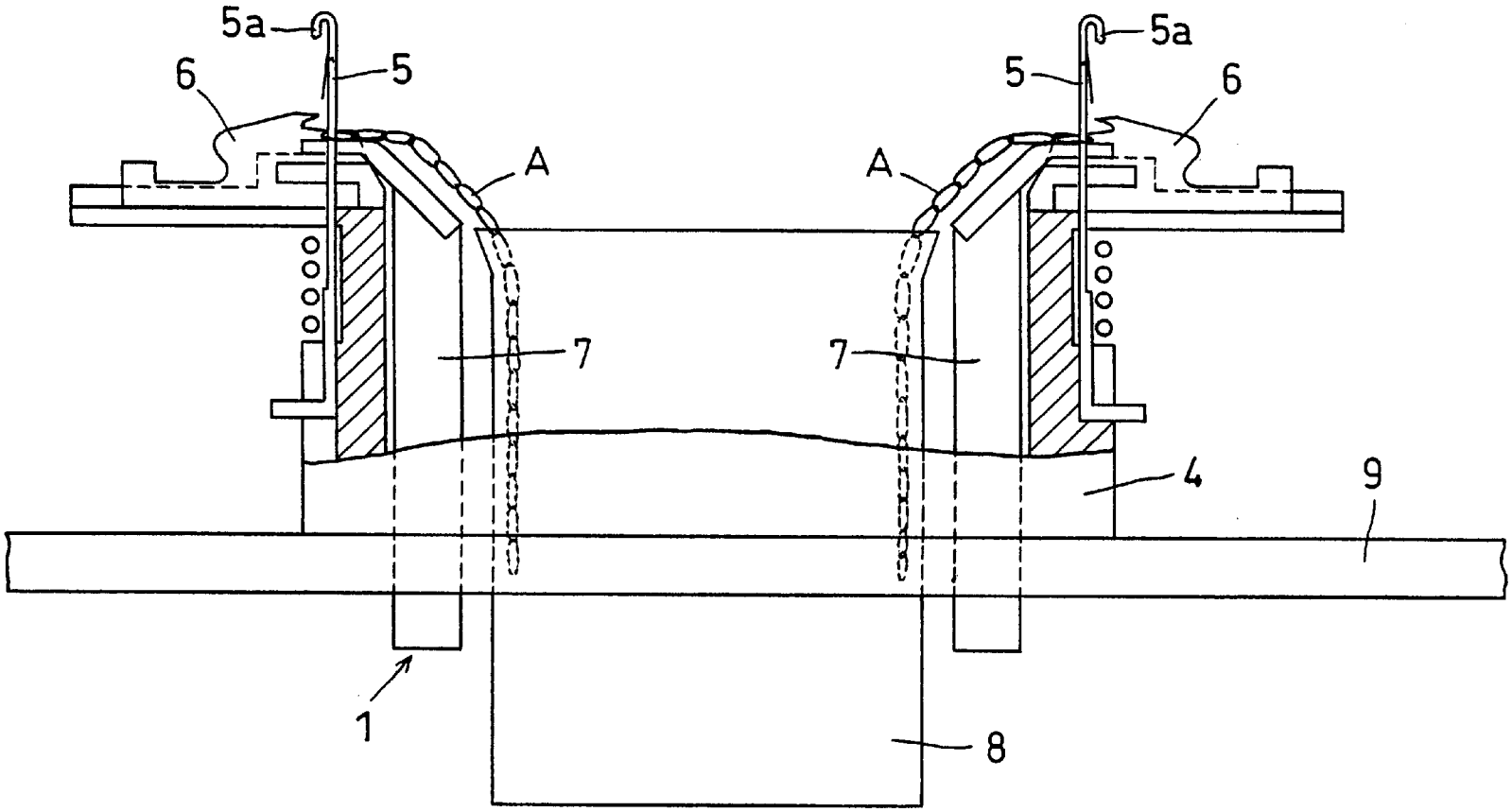
FIG. 22 is a longitudinally enlarged cross sectional front view showing the sock knitting machine with a sock pattern of knitted fabric at the initial stage.

A couple guide rails 27 are mounted at both sides of the axis of the tubular member 13 beneath the base plate 11. A guide 28 is mounted movable on and along an outer half of each the guide rail 27 and has a pivot shaft 29 mounted thereon to which a pair of brackets 30 of substantially an L shape are pivotably joined for horizontal movement. The bracket 30 has a pivot pin 31 mounted to the distal end thereof and one of the transfer needles equipped movable tables 2 is pivotably joined to the pivot pin 31 as shown in FIG. 21. The pivot pin 31 is movably fitted in a slot 33 provided in a positioning guide 32 mounted to the lower side of the base plate 11 so that it can move orthogonal to the guide rail 27.

A guide 34 is mounted movable on and along the inner half of each the guide rail 27 and has a pivot pin 35 mounted thereon to which two of the transfer needles equipped movable tables 2 are joined for pivotal movement. Each of the two transfer needles equipped movable tables 2 has a pivot pin 36 mounted thereon. The pivot pin 36 is movably fitted in an arcuate slot 37 provided in the bracket 30.

Because of the above described arrangement, when the paired brackets 30 are pivoted outwardly through an angle as shown in FIGS. 16 to 19, the transfer needles equipped movable tables 2 are arranged in the circular position about the axis of the tubular member 13. When the paired brackets 30 are shifted inwardly to be parallel with each other as shown in FIG. 20, the transfer needles equipped movable tables 2 are aligned in two opposite rows, four each row.

Figure 19:
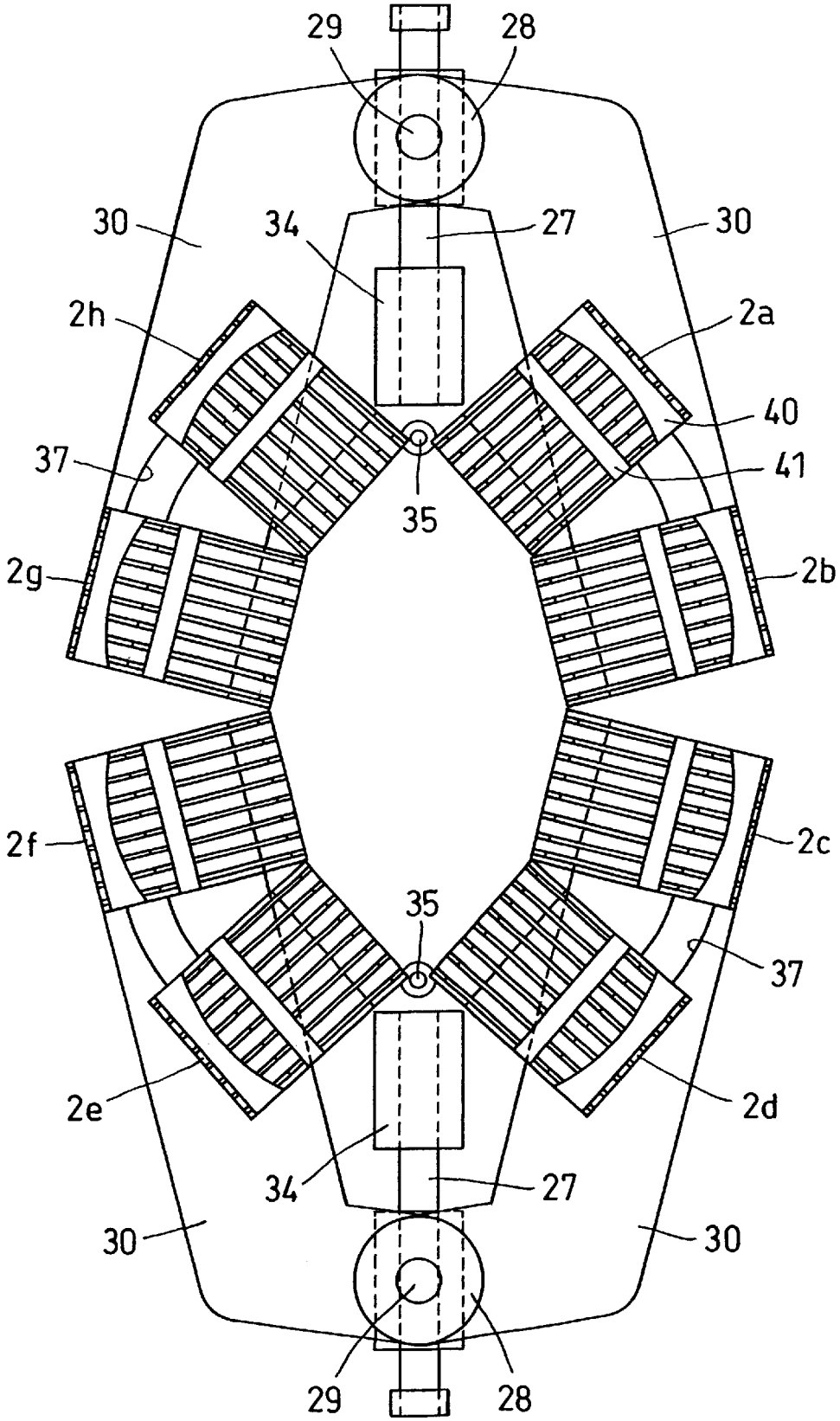
FIG. 19 is an enlarged plan view showing the transfer needles equipped movable tables being further shifted from the state shown in FIG. 18 to the linear position.
Figure 20:
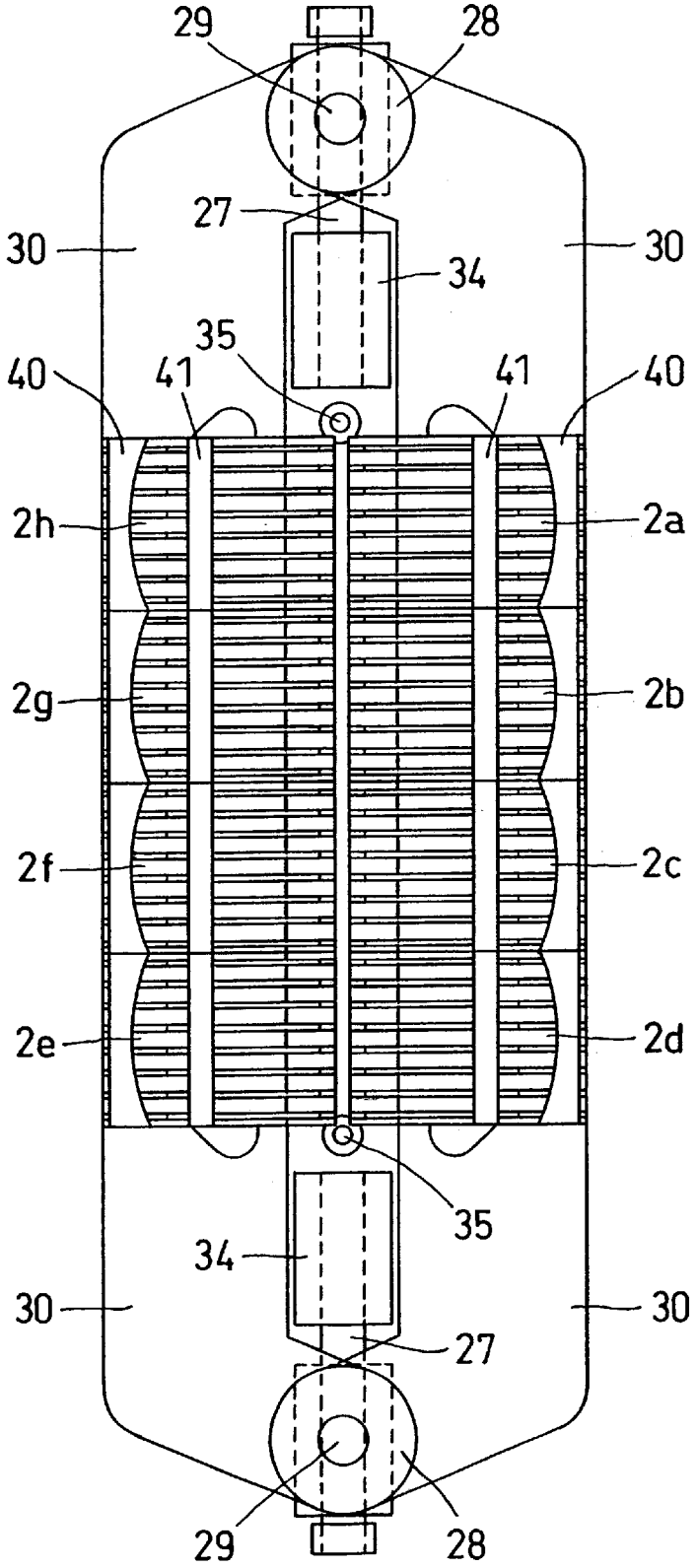
FIG. 20 is an enlarged plan view showing the transfer needles equipped movable tables arranged in the linear position in the sock transfer mechanism.

As the transfer needles equipped movable tables 2*a* to 2*h* are moved inwardly as shown in FIGS. 19 to 20, they may collide with each other. For compensation, the pivot pins 29 for the brackets 30 are dislocated from the pins 35, whereby the transfer needles equipped movable tables 2 can be aligned in two rows as shown in FIG. 20.

The pivotal movement of the brackets 30 may be actuated by an air cylinder or an electric motor.

Figure 13:
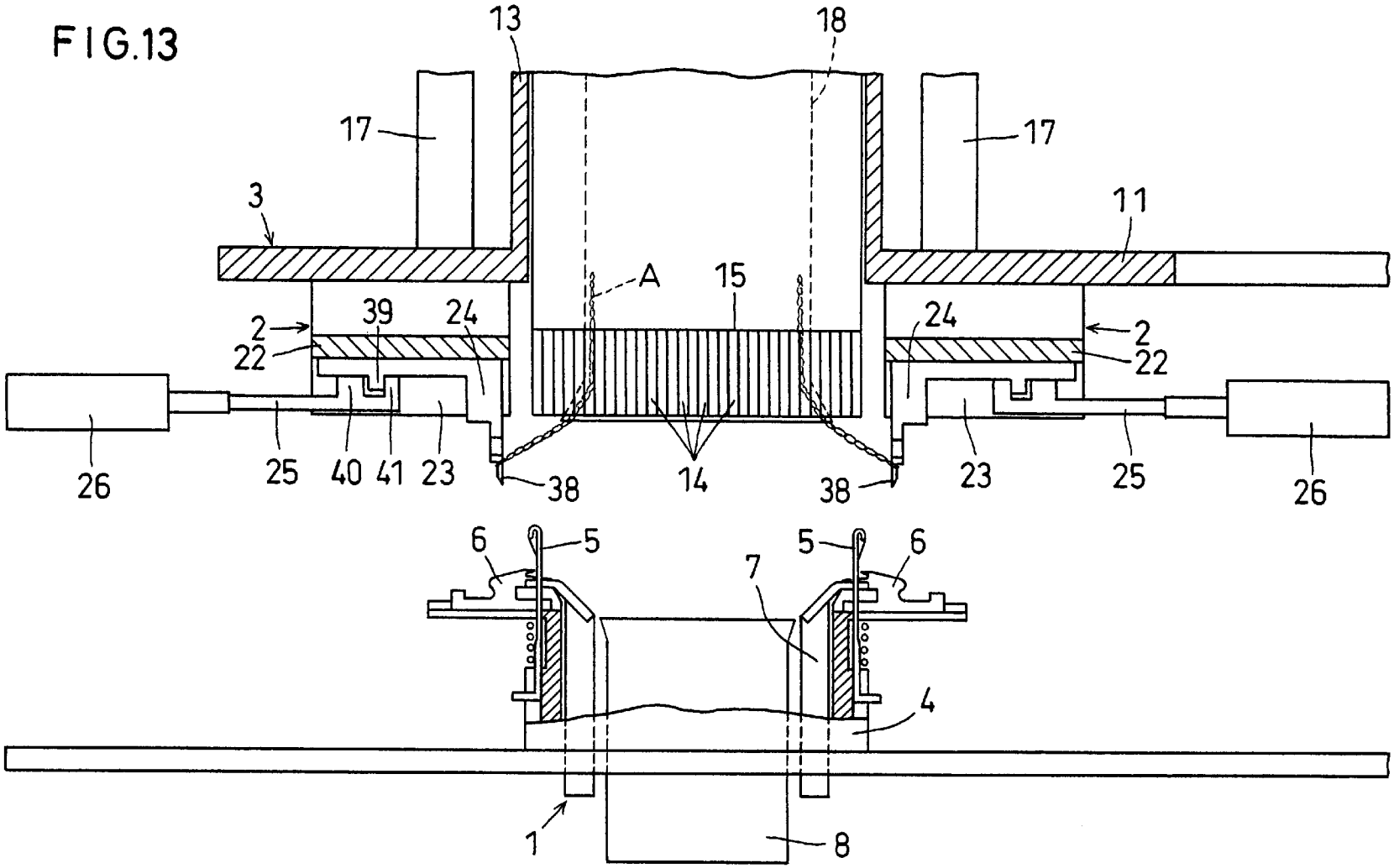
FIG. 13 is a longitudinally cross sectional front view showing the transfer needles equipped movable tables spaced from the guide ring in the sock transfer mechanism.

The total number of the transfer needles 24 mounted in the grooves 23 of the transfer needles equipped movable tables 2 shown in FIG. 13 is equal to the number of the knitting needles 5 of the sock knitting machine 1. Also, the number of the grooves 14 provided in the outer side of the guide ring 15 is the same.

Figure 25:
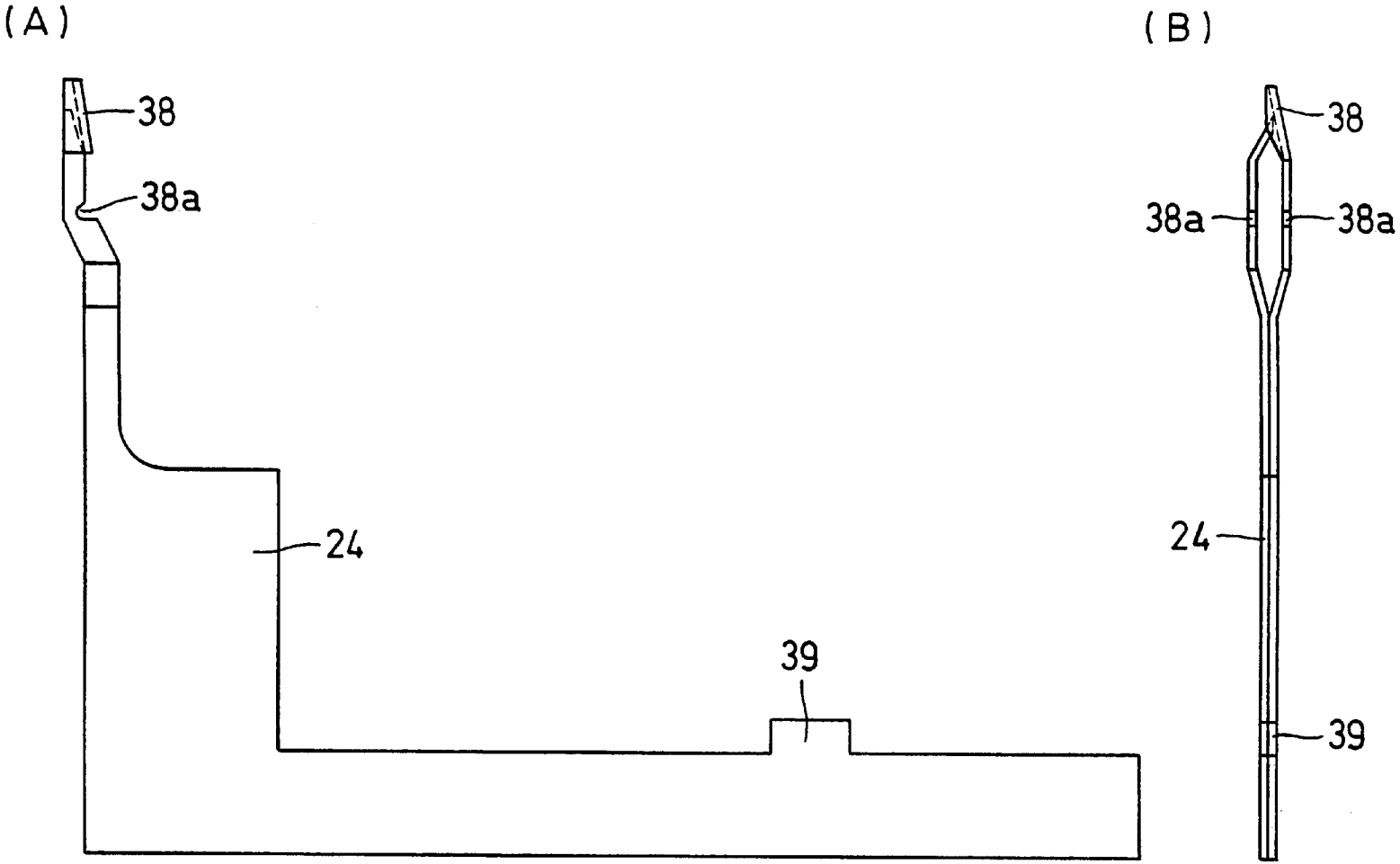
FIGS. 25A and 25B are a front view and a side view of the transfer needles respectively.
Figure 26:
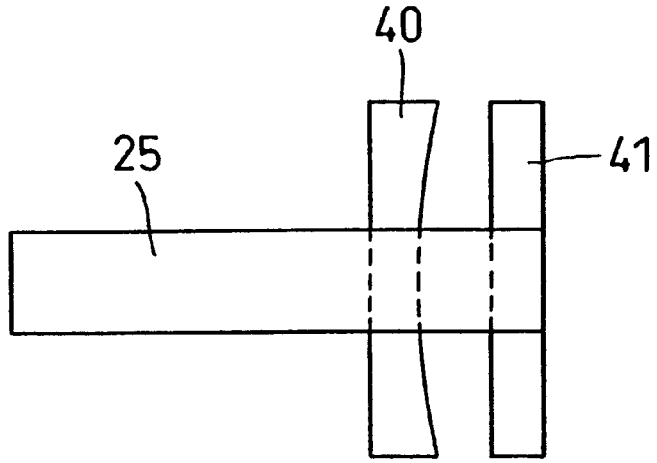
FIGS. 26A and 26B are a plan view and a side view of a cam member respectively.
Figure 26:
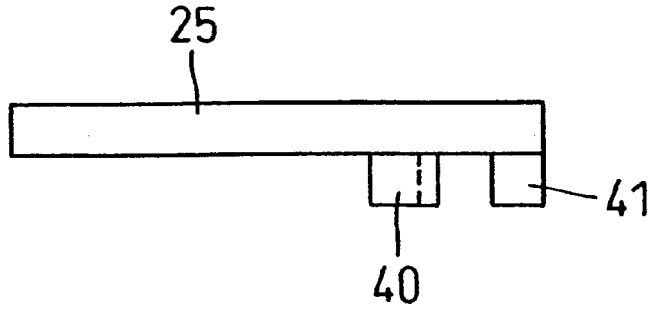

As best shown in FIG. 25, the transfer needle 24 is arranged of an inverted L shape having an annular tip 38 provided at the distal end thereof for opening and closing motions and a pad 39 provided on a center region of a leg portion thereof which is fitted in the groove 23 of the transfer needles equipped movable table 2. The cam member 25 for driving the transfer needle 24 has, as shown in FIG. 26, a cam 40 mounted thereon for moving the transfer needle 24 forward to its circular position and a cam 41 mounted thereon for moving the transfer needle 25 backward to its linear position, both cams sandwiching the pat 39. The transfer needles 24 and the cam members 25 of each transfer needles equipped movable table 2 can be driven at once by the single cylinder 26.

While the sock knitting apparatus of the present invention has the foregoing arrangement, a method of knitting the toe of a sock will now be described.

Referring to FIGS. 1 to 22, when the fabrication of a sock pattern of knitted fabric A is completed in the sock knitting machine 1, the sock transfer mechanism 3 drives the horizontal base plate 11 to turn about the support post 10 until it stops just above the sock knitting machine 1. As a result, the tubular member 13, the guide ring 15, and the vacuum pipe 18 of the sock transfer mechanism 3 are positioned coaxially of the cylinder 4 of the sock knitting machine 1. The base plate 11 may be driven by an air cylinder or an electric motor.

At the time, the base plate 11 is at its upper position while the lower sides of the guide ring 15 and the vacuum pipe 18 remain high above the base plate 11. The transfer needles equipped movable tables 2 mounted to the lower side of the base plate 11 are arranged in the circular position coaxially of the cylinder 4 of the sock knitting machine 1 so that their inner diameter is slightly greater than the diameter of the cylinder 4. The transfer needles 24 of the transfer needles equipped movable tables 2 remain retracted from the front end of the transfer needles equipped movable tables 2 and their downwardly extending tips 38 are vertically spaced from the upper ends of the corresponding knitting needles 5 of the sock knitting machine 1.

Figure 23:
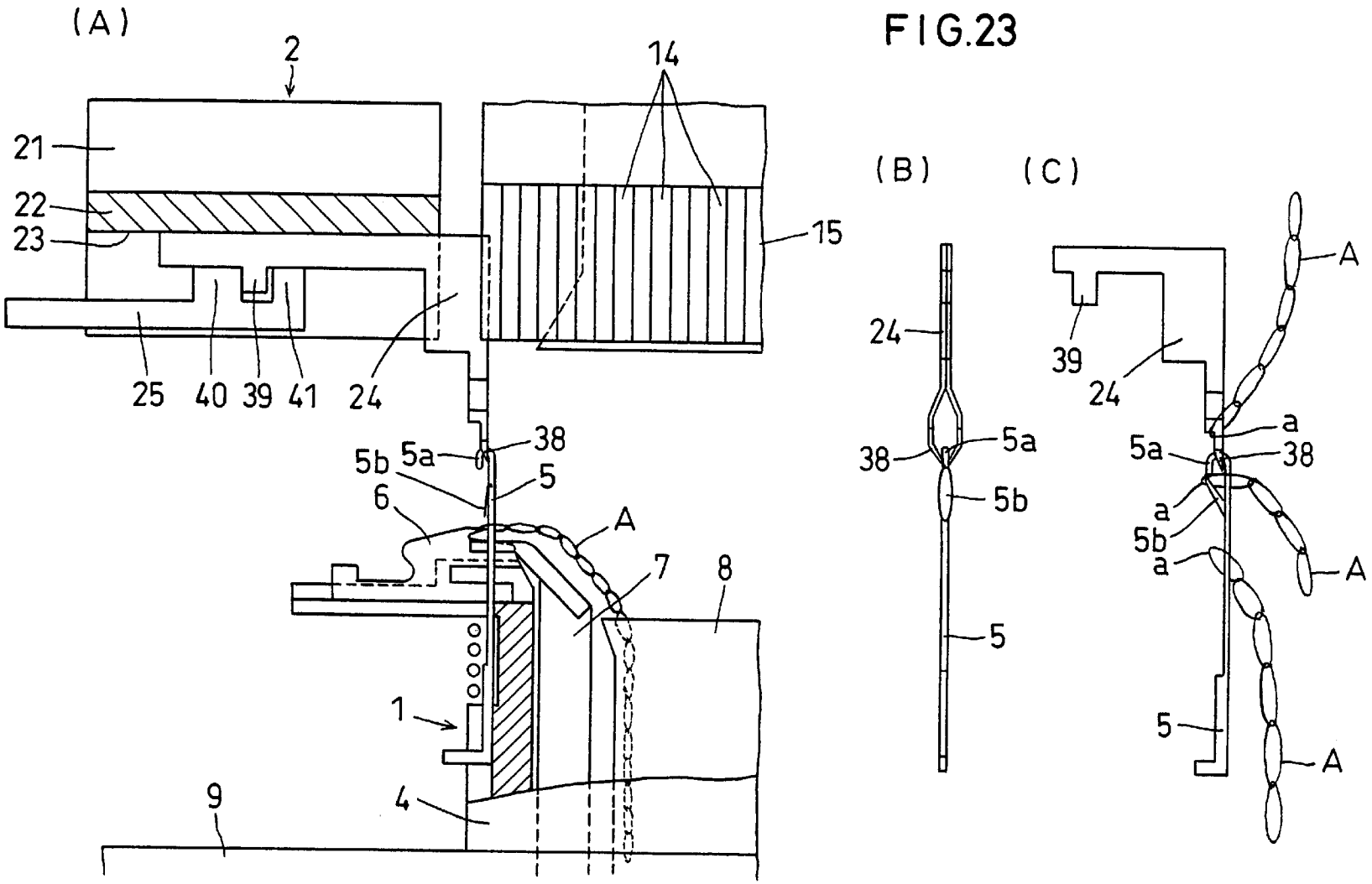
FIGS. 23A, 23B, and 23C are a longitudinally cross sectional front view showing the relationship between knitting needles and transfer needles, an enlarged side view showing the relationship between the knitting needles and the transfer needles, and an explanatory view showing loops of the sock pattern of knitted fabric being transferred from the sock knitting machine to the transfer mechanism respectively.
Figure 24:
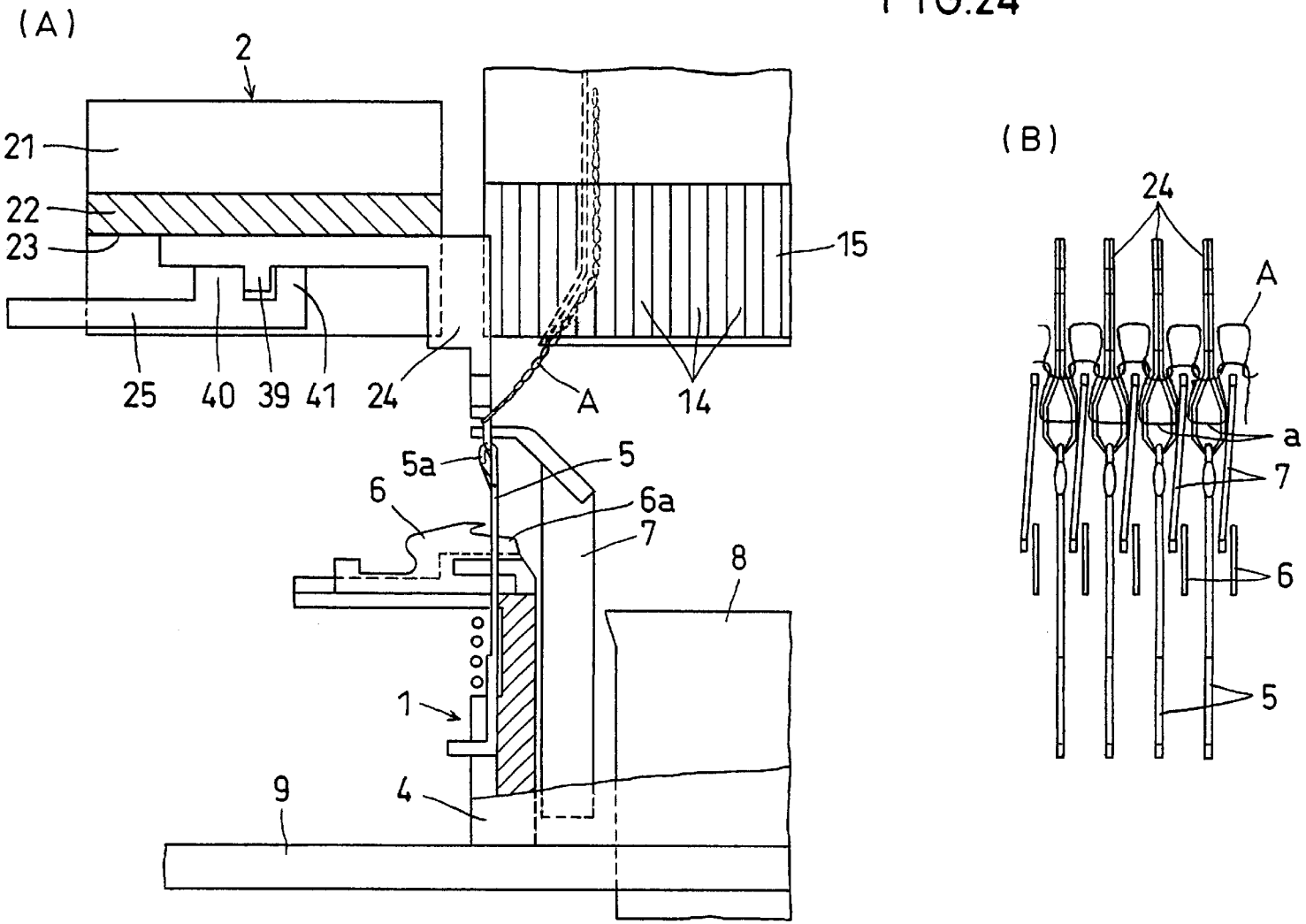
FIGS. 24A and 24B are a longitudinally cross sectional front view showing the relationship between the knitting needles and the transfer needles with the loops of the sock pattern of knitted fabric being transferred and an enlarged side view showing the relationship between the knitting needles and the transfer needles respectively.

As the sock knitting machine 1 finished its action of fabricating the sock pattern of knitted fabric A, its knitting needles 5 are lifted up to the clear position with the cylinder 4 held at the original position. At the time, as the sock pattern of knitted fabric A is pulled down in the sock knitting machine 1 by the suction of the vacuum pipe 8, its toe loops a are off the latches 5*b* of the knitting needles 5 and stay on the sinkers 6a as shown in FIGS. 23 and 24.

Figure 3:
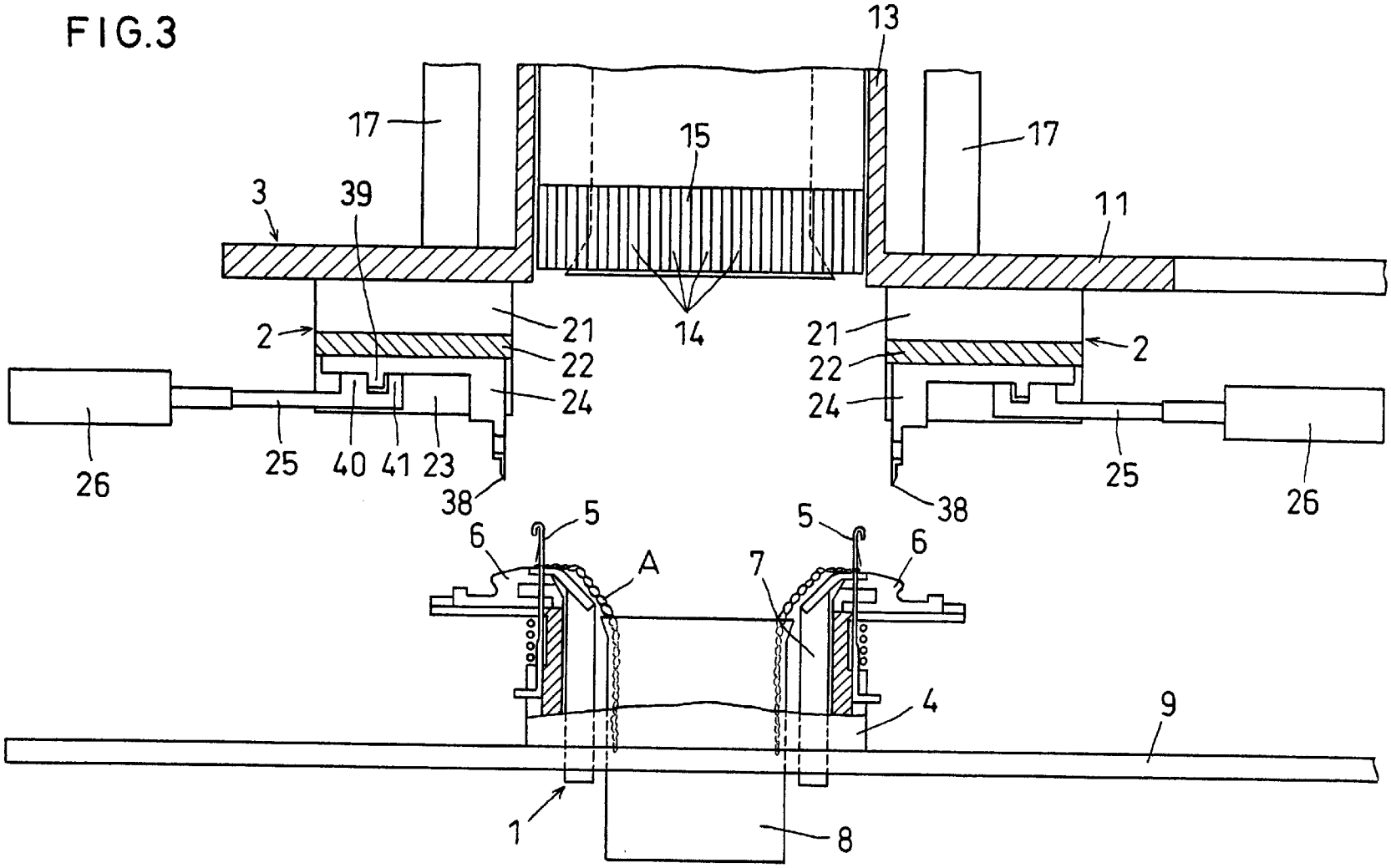
FIG. 3 is a longitudinally cross sectional front view showing a transfer bit lifted up.
Figure 4:
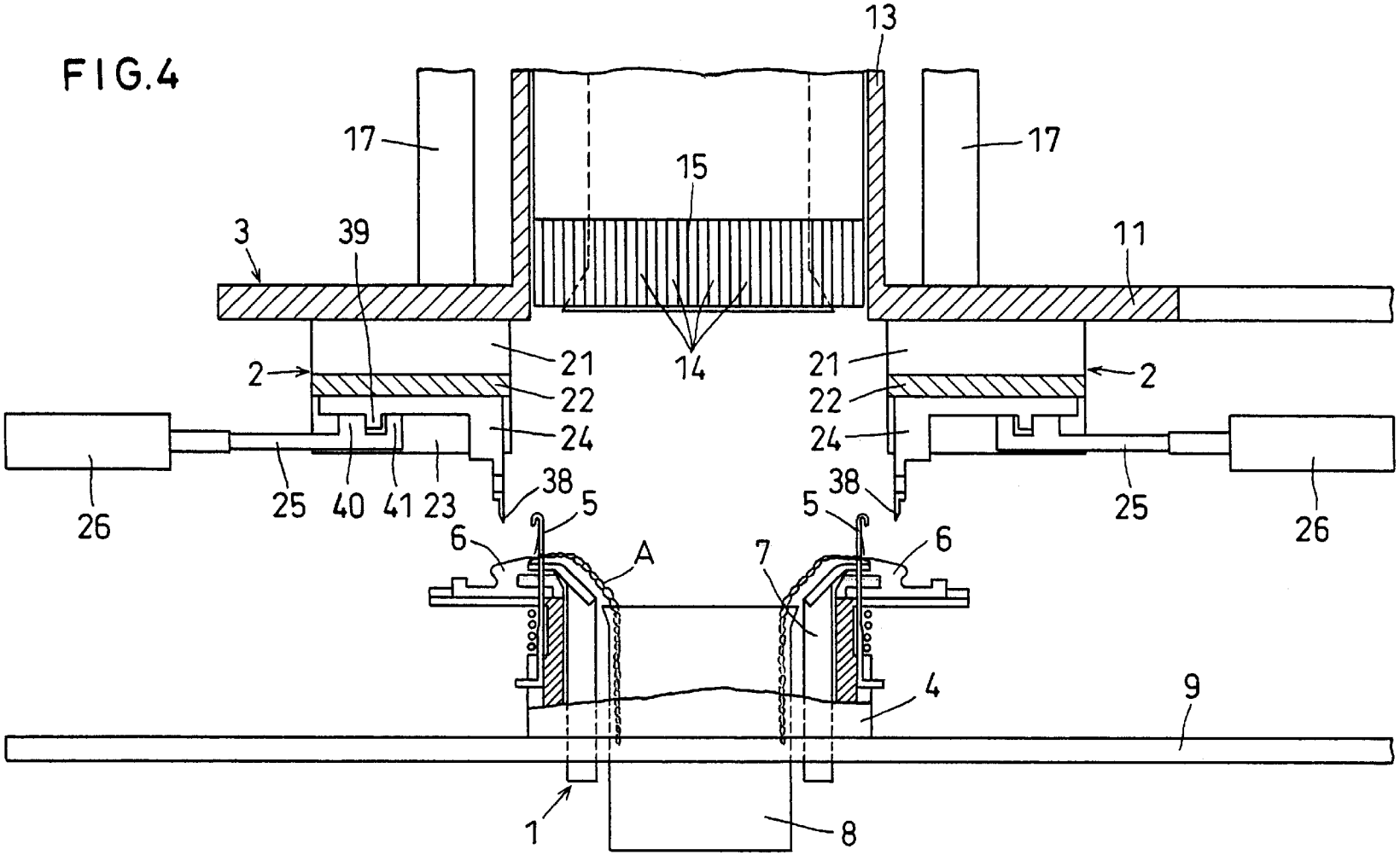
FIG. 4 is a longitudinally cross sectional front view showing the sock transfer mechanism lifted down.

Then, a latch ring (not shown) is elevated and the transfer bit 7 is lifted up to one step as shown in FIG. 3. The cylinder 4 of the sock knitting machine 1 is moved one full turn and the suction of the vacuum pipe 8 is canceled. The cylinder 4 is moved again one full turn and the loops a of the sock pattern of knitted fabric A are held on the fingers of the corresponding sinkers 6.

Figure 2:
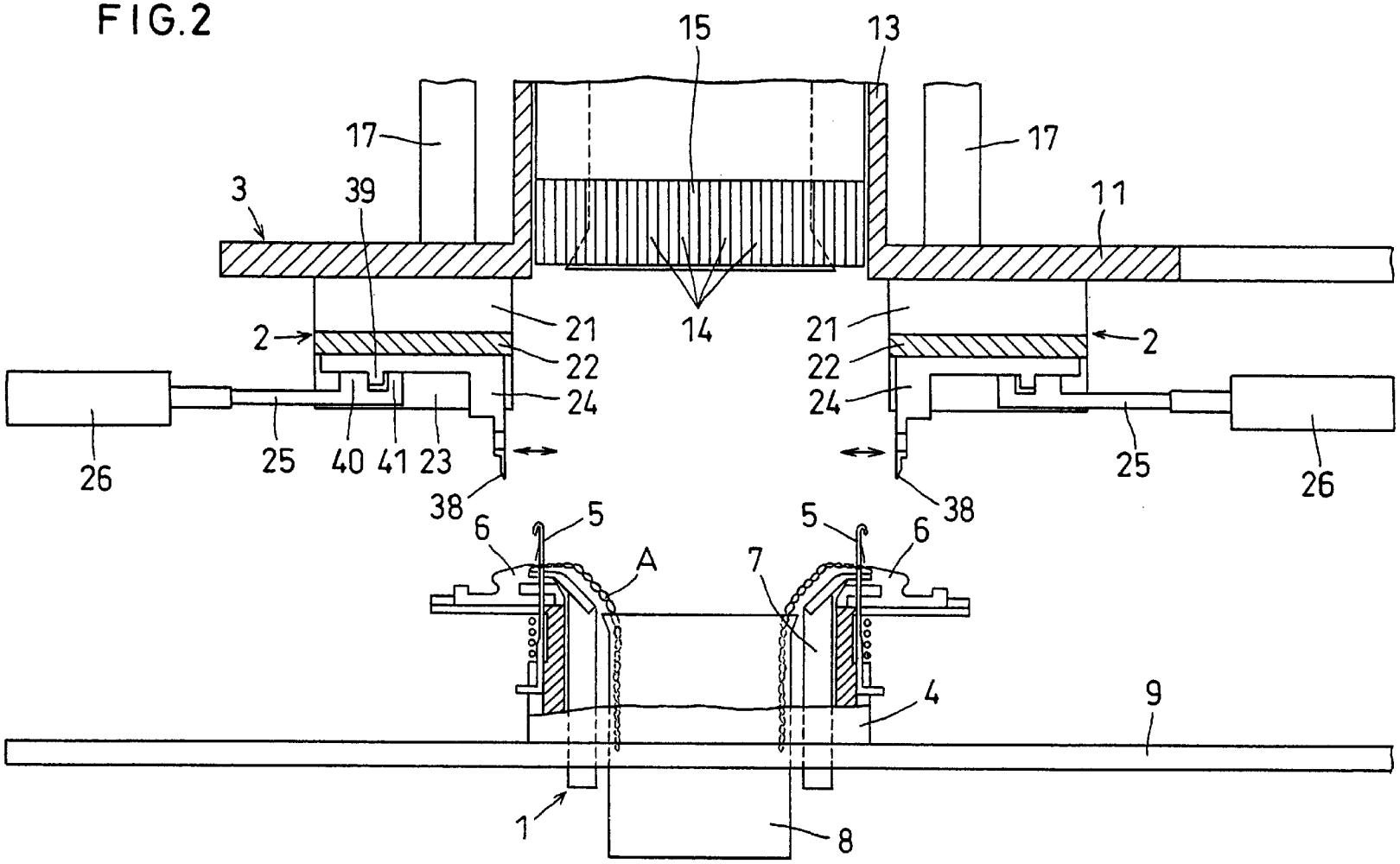
FIG. 2 is a longitudinally cross sectional front view of the sock transfer mechanism and the sock knitting machine with the sock pattern of knitted fabric held thereon at the initial stage.
Figure 5:
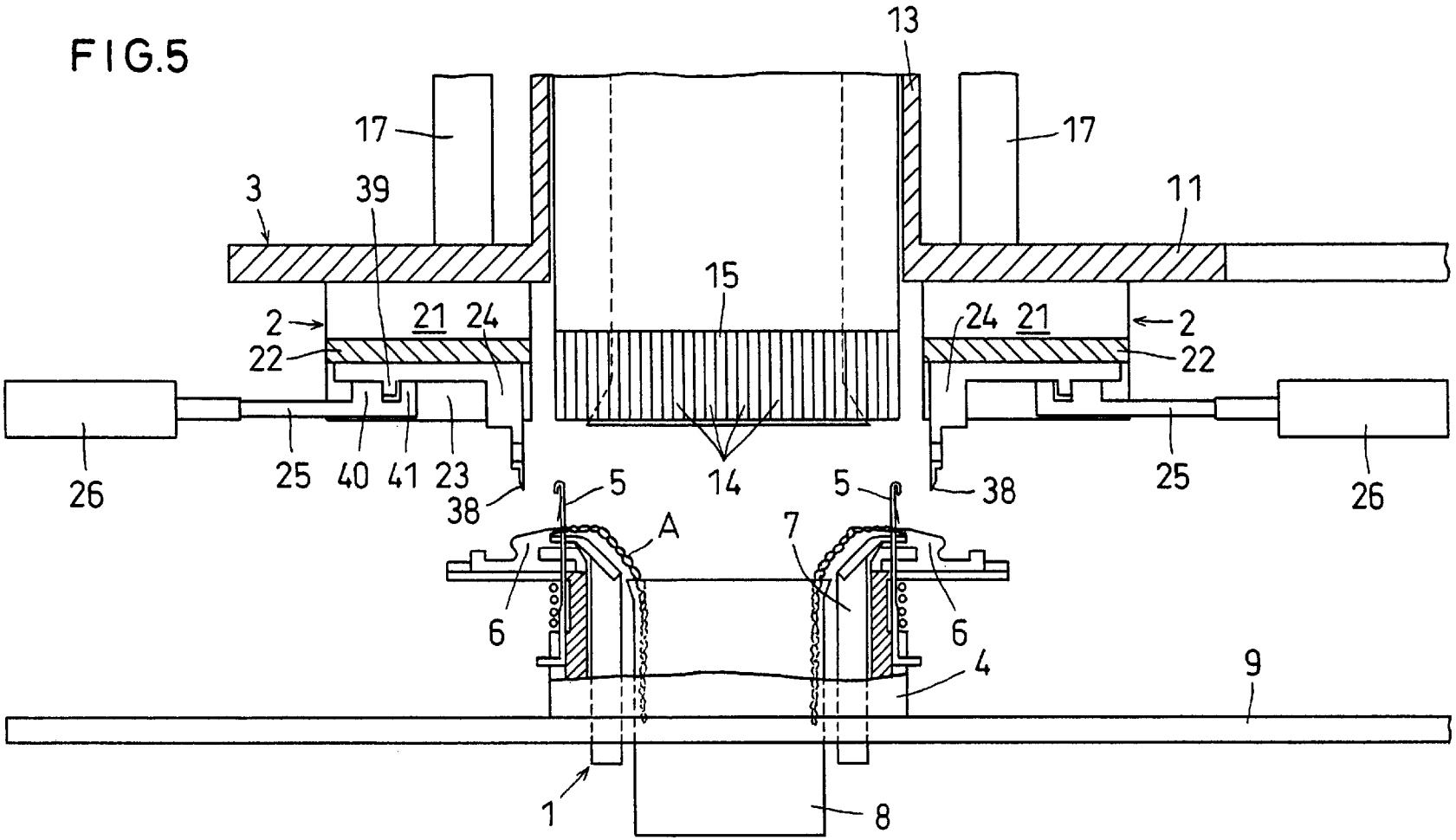
FIG. 5 is a longitudinally cross sectional front view showing a guide ring in the sock transfer mechanism lifted down.

This is followed by lifting down the transfer bit 7 of the sock knitting machine 1 to its lower position shown in FIG. 2. Then, the base plate 11 of the sock transfer mechanism 3 just above the sock knitting machine 1 is lowered to the transfer position shown in FIG. 4 by the action of the air cylinder 12 so that the tips 38 of the transfer needles 24 on the movable tables 2 come flush with the hooks 5*a* of the knitting needles 5 of the sock knitting machine 1. Simultaneously, the guide ring 15 and the vacuum pipe 18 are lowered by the action of the air cylinders 17 as shown in FIG. 5 until the lower end of the guide ring 15 moves into the circular position of the transfer needles equipped movable tables 2 and comes to the height level of the transfer needles 24.

Figure 6:
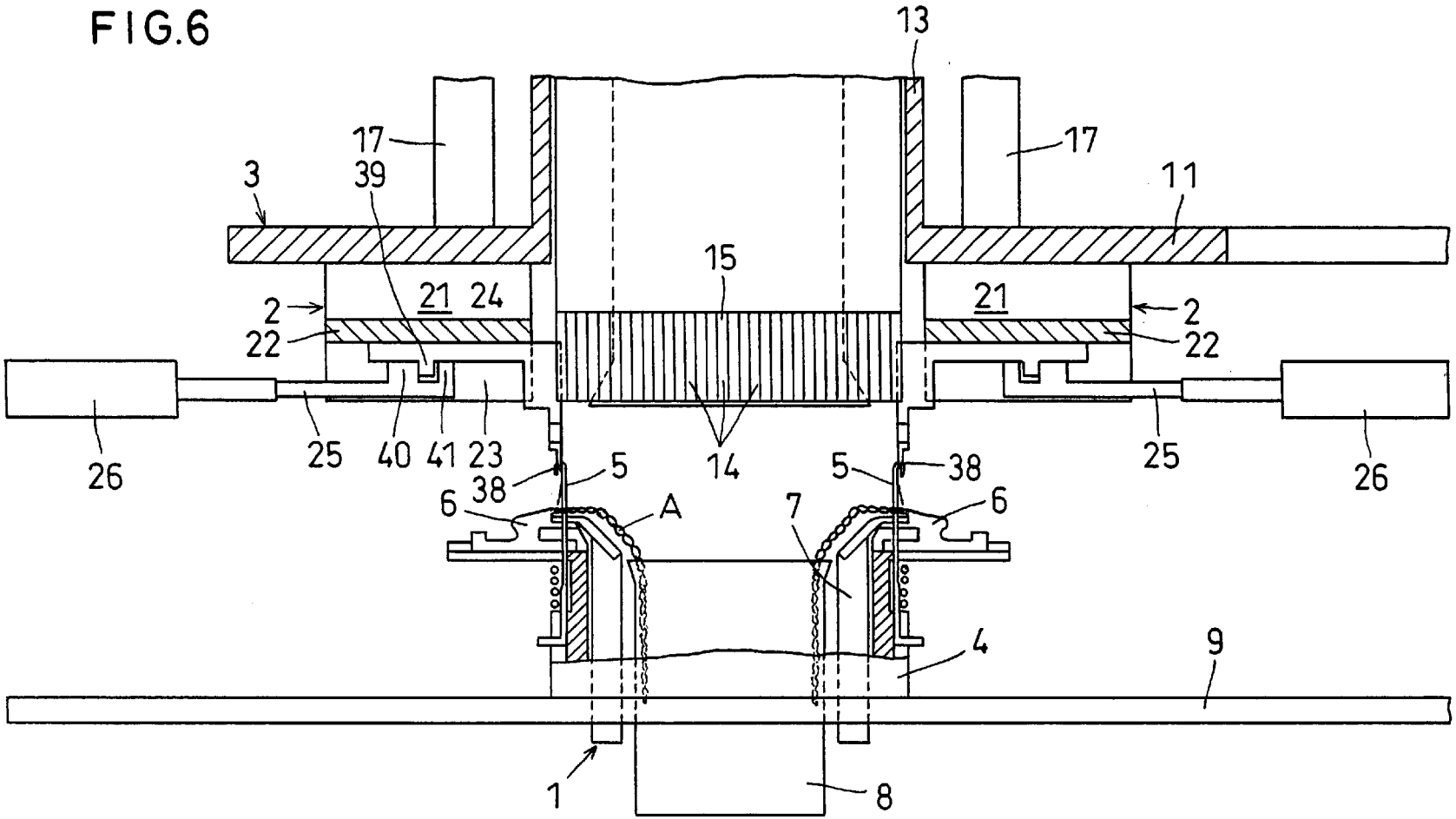
FIG. 6 is a longitudinally cross sectional front view showing transfer needles equipped movable tables moved close to the guide ring in the sock transfer mechanism.
Figure 17:
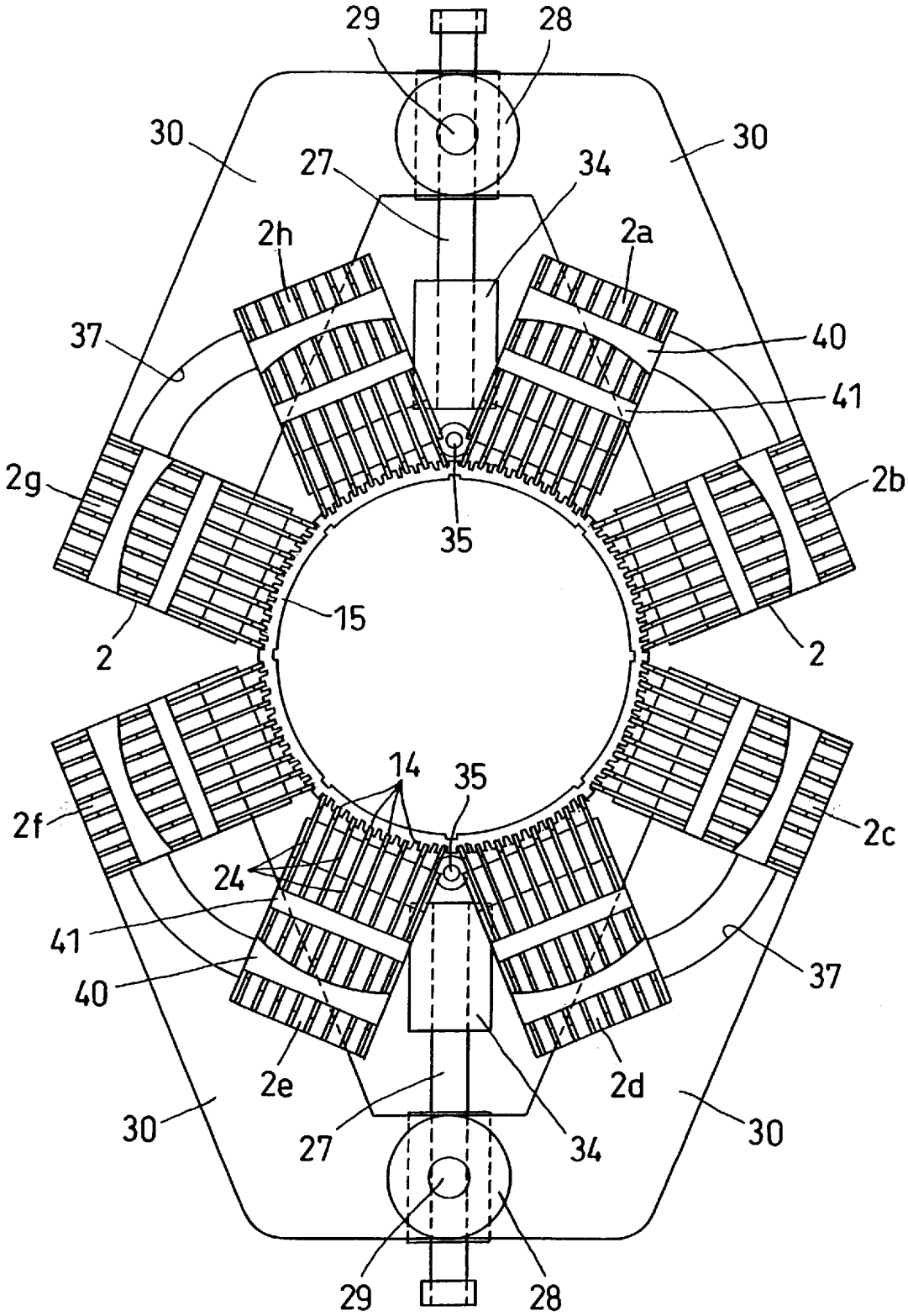
FIG. 17 is an enlarged plan view showing the transfer needles equipped movable tables aligned about the outer side of the guide ring in the sock transfer mechanism.
Figure 18:
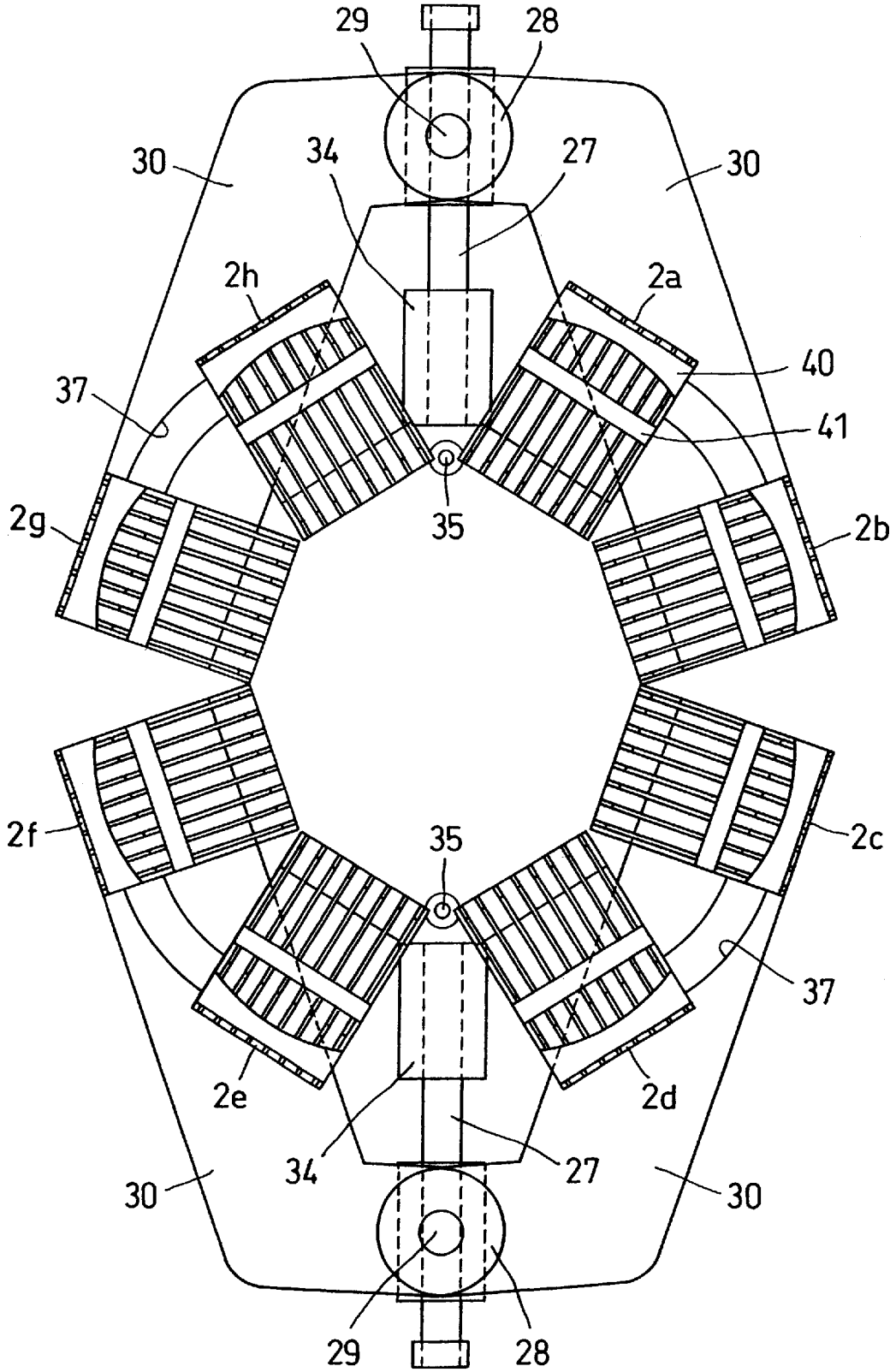
FIG. 18 is an enlarged plan view showing the transfer needles equipped movable tables being shifted to the linear position in the sock transfer mechanism.

Then, the air cylinders 26 of the transfer needles equipped movable tables 2 are actuated to drive the cams 40 of the cam member 25 and thus push the transfer needles 24 forward to their arcuate position facing the guide ring 15 as shown in FIG. 6. When the transfer needles 24 are further advanced at their front end into the corresponding grooves 14 provided in the guide ring 14, they are positioned in a circle about the axis of the cylinder 4 of the sock knitting machine 1 as shown in FIG. 17. As a result, the tips 38 of the transfer needles 24 come in engagement with the hooks 5*a* of the corresponding knitting needles 5 of the sock knitting machine 1 as shown in FIG. 23.

Figure 7:
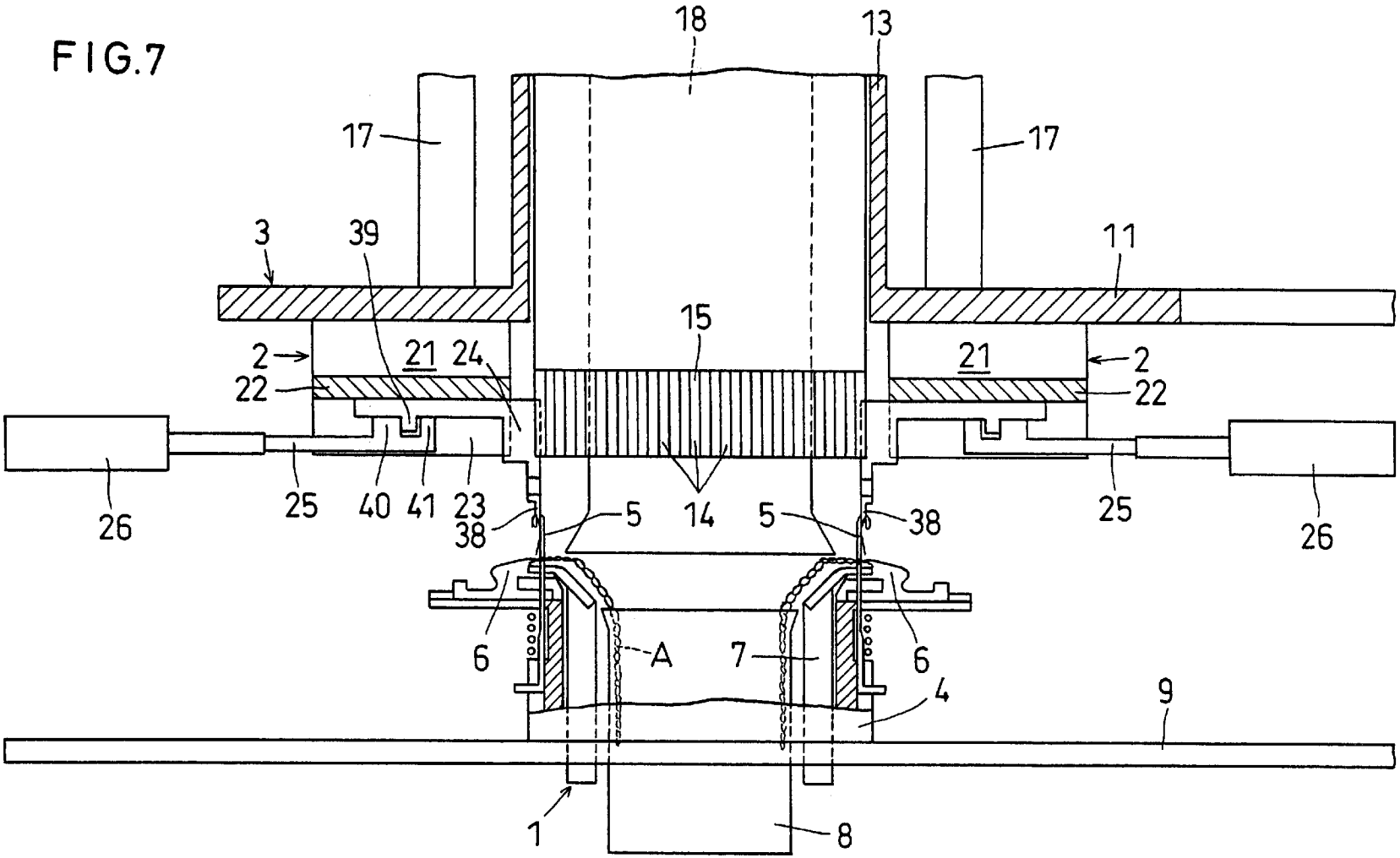
FIG. 7 is a longitudinally cross sectional front view showing a vacuum pipe lifted down in the sock transfer mechanism.
Figure 8:
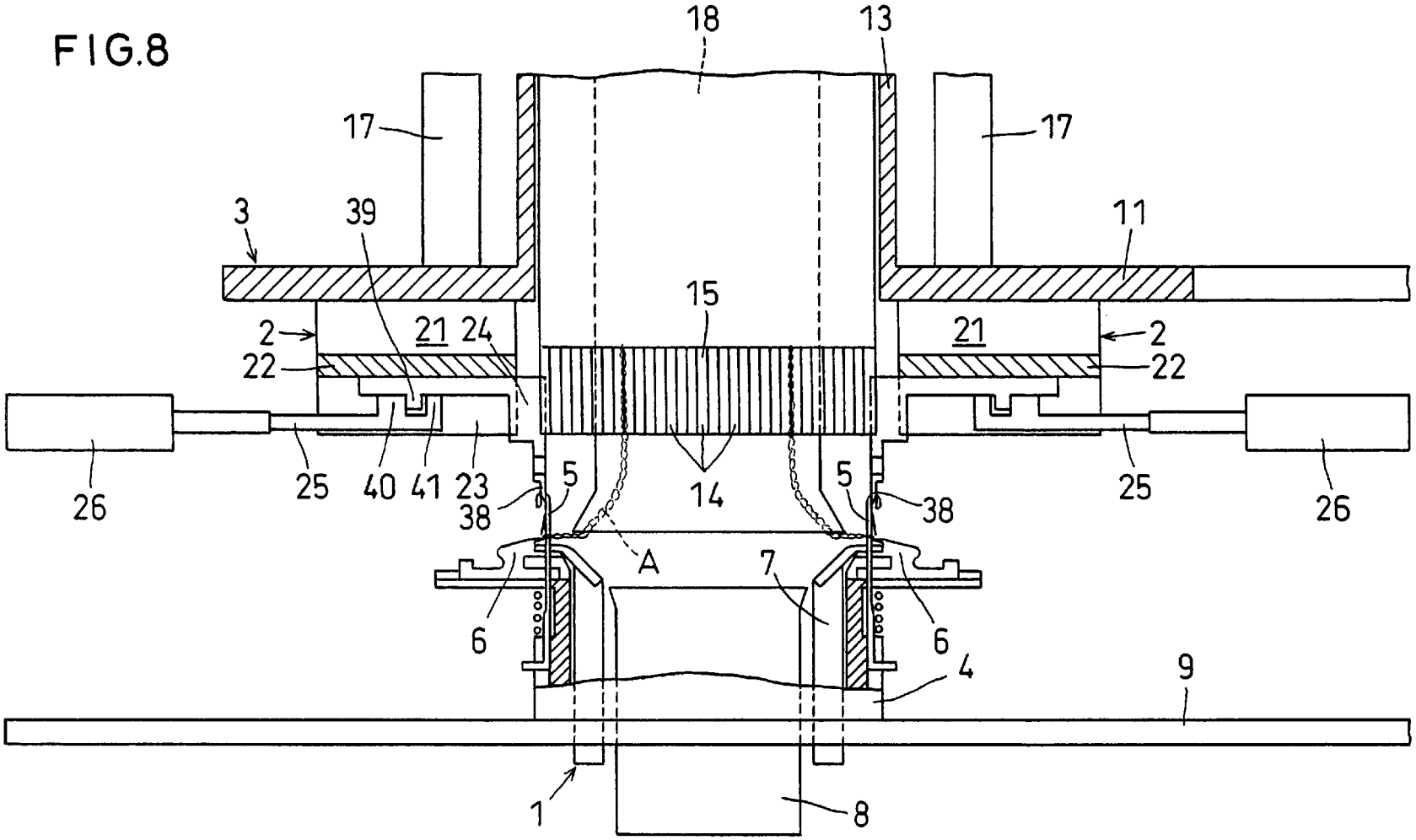
FIG. 8 is a longitudinally cross sectional front view showing the vacuum pipe holding the sock pattern of knitted fabric by the suction in the sock transfer mechanism.
Figure 9:
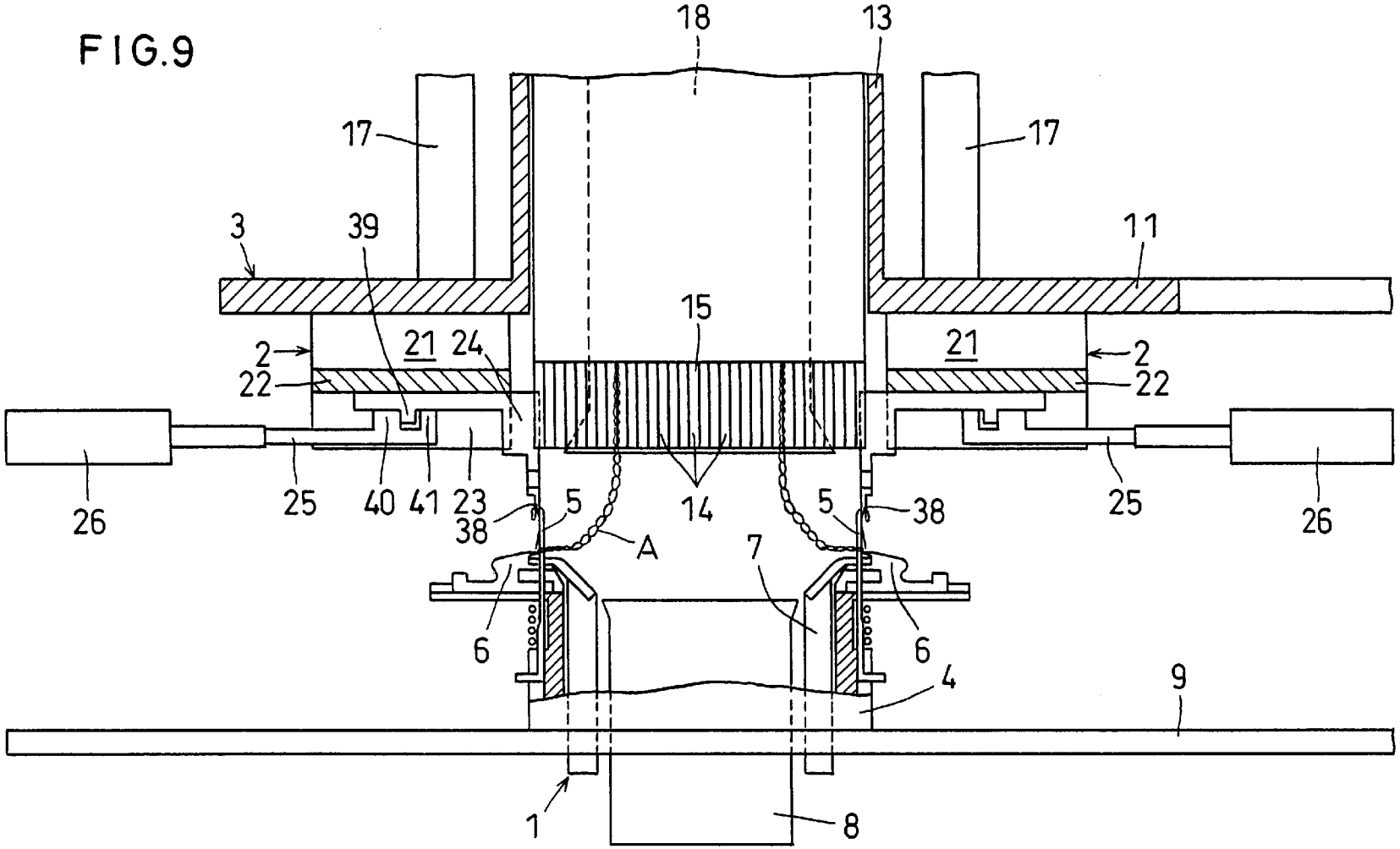
FIG. 9 is a longitudinally cross sectional front view showing the vacuum pipe lifted up in the sock transfer mechanism.

This is followed by the retracting action of the air cylinder 20 lowering the vacuum pipe 18 until its lower opening end comes flush with the sinkers 6, as shown in FIG. 7. Then, the vacuum pipe 18 is actuated with its blower for suction of the sock pattern of knitted fabric A from the sock knitting machine 1. As a result shown in FIG. 8, the sock pattern of knitted fabric A is turned inside out by the suction. The air cylinder 20 is then advanced to lift the vacuum pipe 18 up to the position shown in FIG. 9 where it is held in the guide ring 15.

Figure 10:
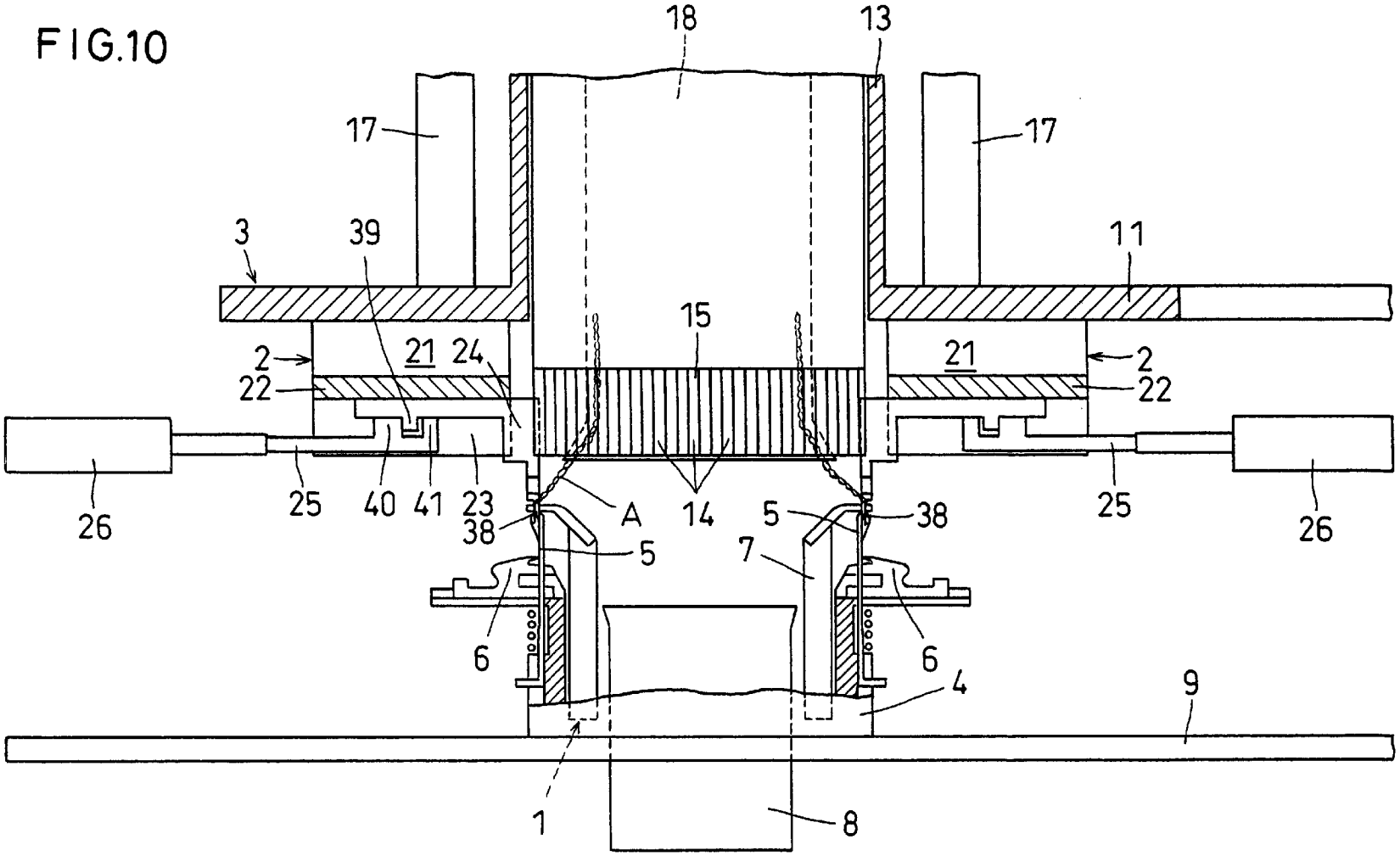
FIG. 10 is a longitudinally cross sectional front view showing the transfer bit lifted up.
Figure 11:
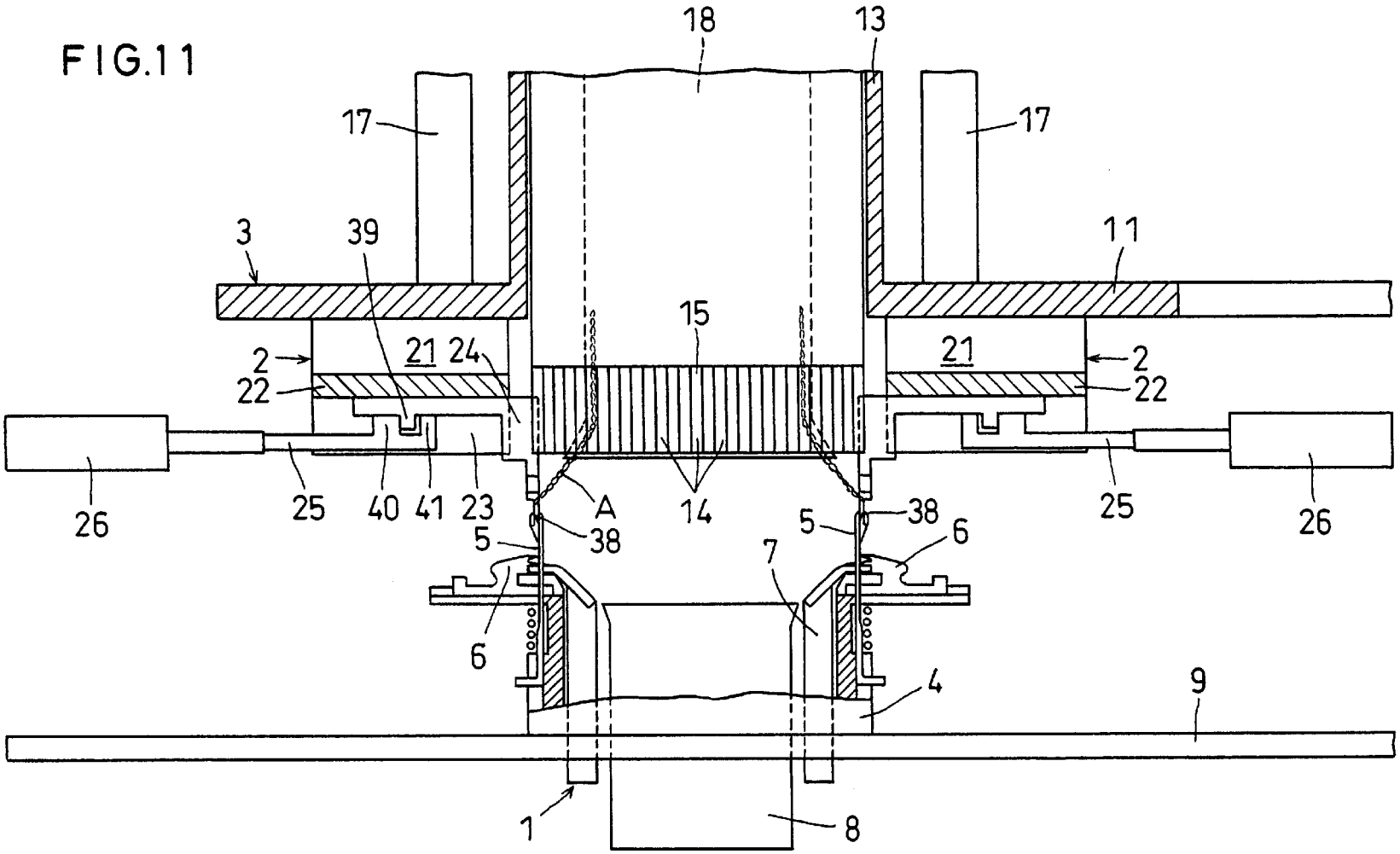
FIG. 11 is a longitudinally cross sectional front view showing the transfer bit lifted down.

Then, the transfer bit 7 of the sock knitting machine 1 is lifted up until the loops a of the sock pattern of knitted fabric A are held on the corresponding transfer needles 24, as shown in FIG. 10. FIGS. 23 and 24 illustrate a step of the loops a of the sock pattern of knitted fabric A are being transferred from the knitting needles 5 of the sock knitting machine 1 to the transfer needles 24. When the sock pattern of knitted fabric A turned inside out is lifted up by the suction of the vacuum pipe 18 with the transfer needles 24 engaged with the hooks 5*a* of the corresponding knitting needles 5, their loops a can smoothly be transferred from the knitting needles 5 to the corresponding transfer needles 24. As the loops a have been transferred to the transfer needles 24, the sock pattern of knitted fabric A fabricated by the sock knitting machine 1 and turned inside out is now held in the sock transfer mechanism 3. The transfer bit 7 is then lowered to its no-action position.

Figure 12:
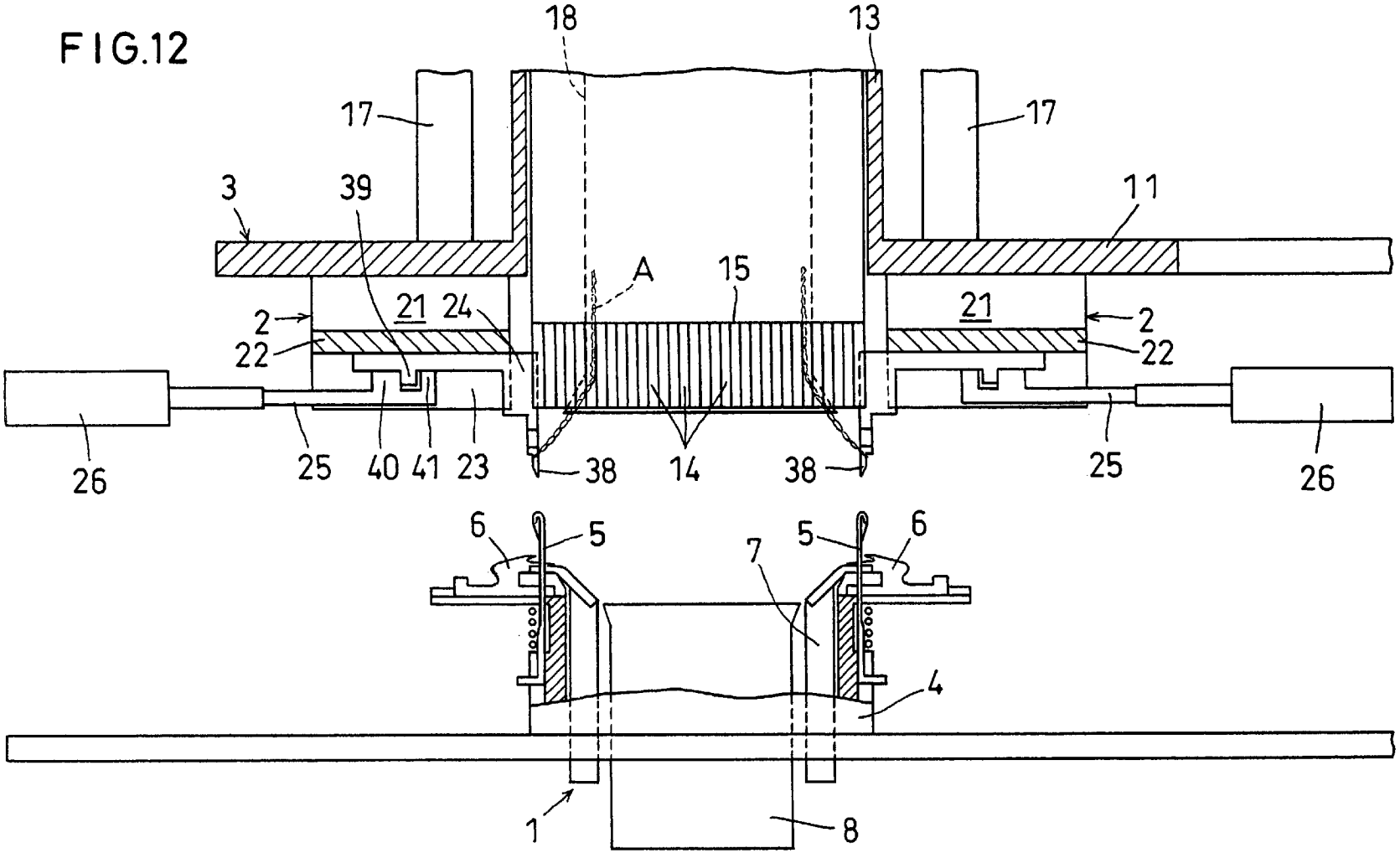
FIG. 12 is a longitudinally cross sectional view showing the sock transfer mechanism lifted up.

This is followed by the air cylinder 12 advancing to return the base plate 11 from the lower position to the upper position shown in FIG. 12 and disengage the tips 38 of the transfer needles 24 from the hooks 5*a* of the corresponding knitting needles 5.

Figure 14:
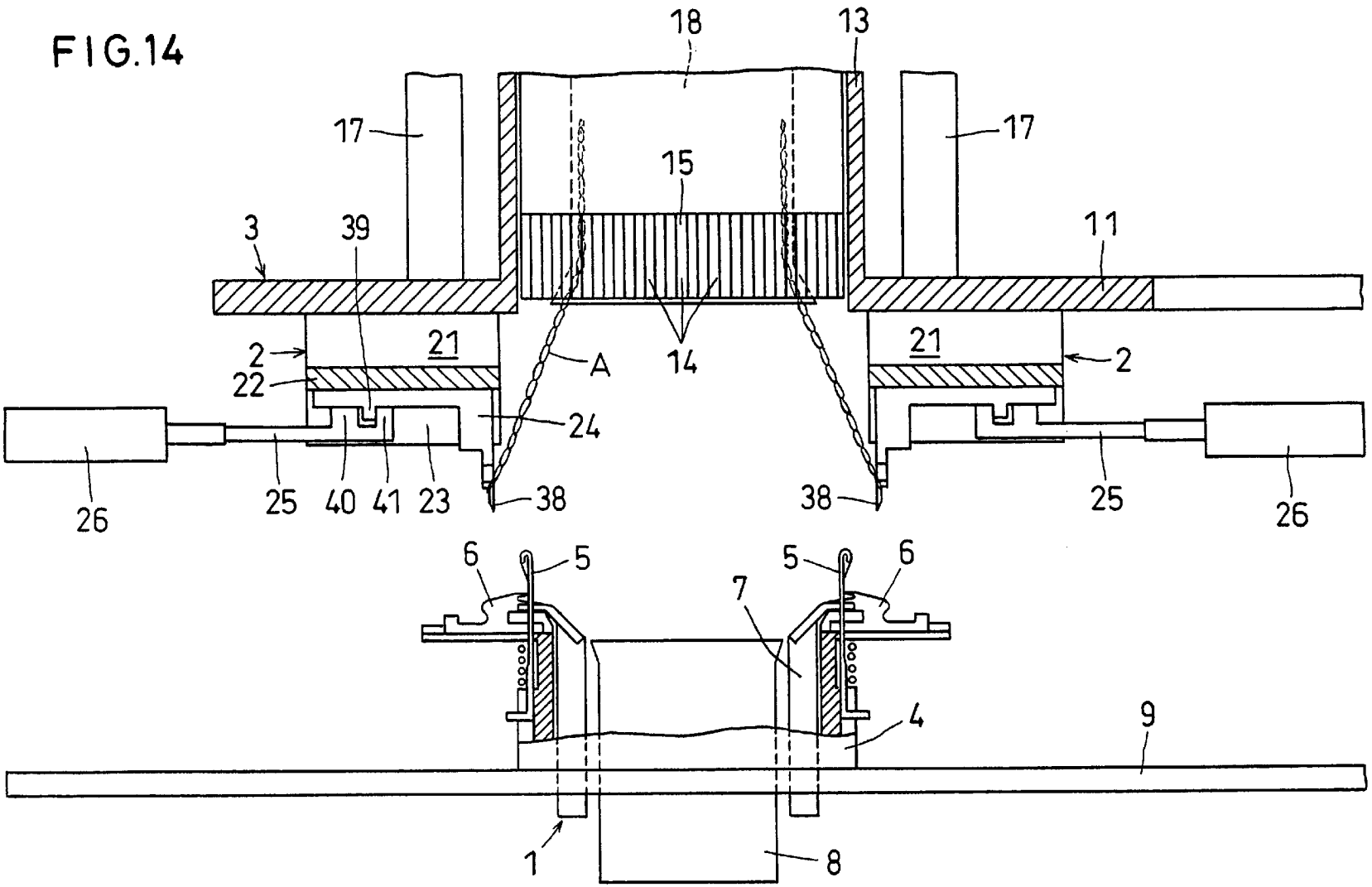
FIG. 14 is a longitudinally cross sectional front view showing the guide ring lifted up in the sock transfer mechanism.
Figure 15:
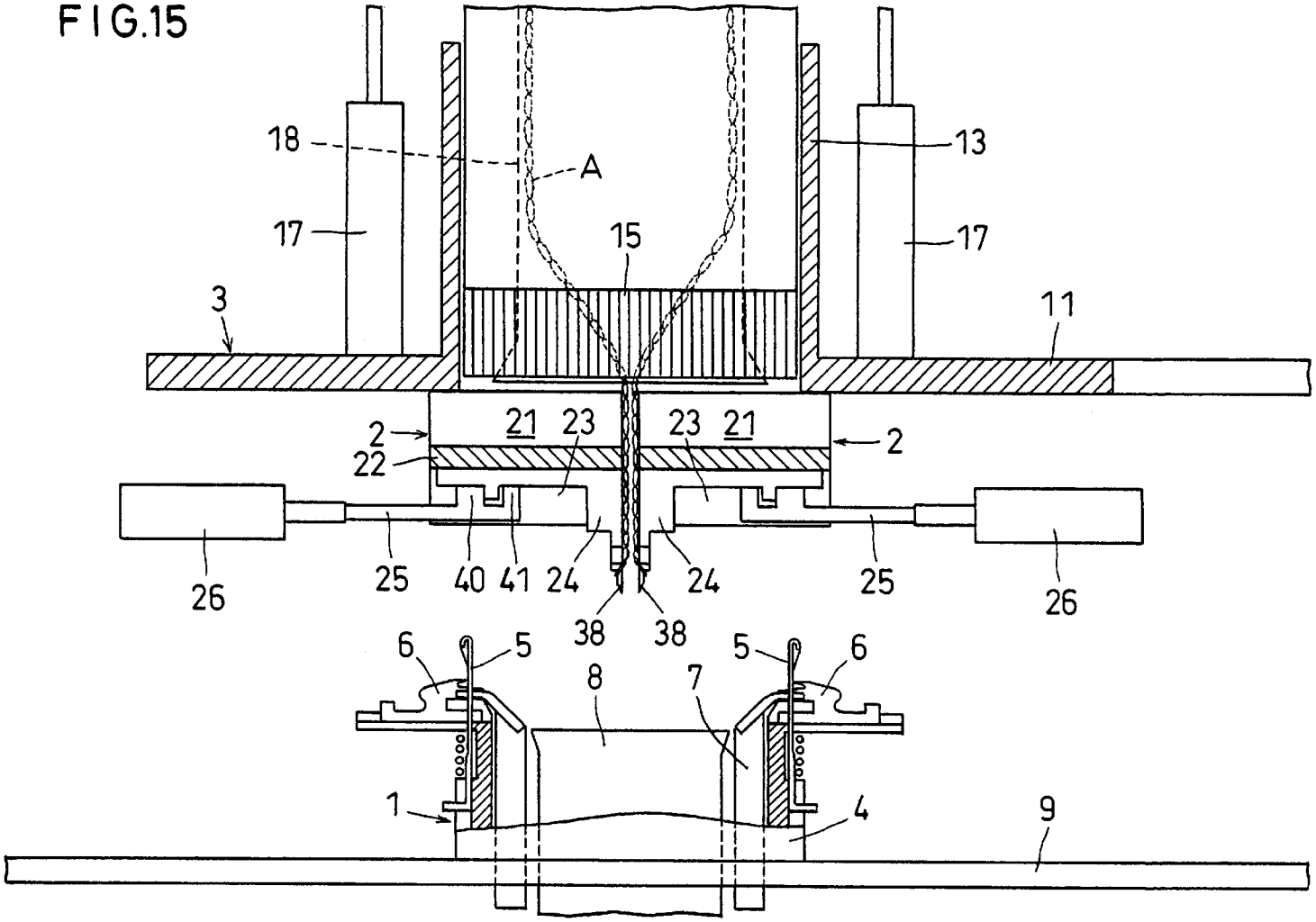
FIG. 15 is a longitudinally cross sectional front view showing the transfer needles equipped movable tables arranged in a linear position in the sock transfer mechanism.
Figure 16:
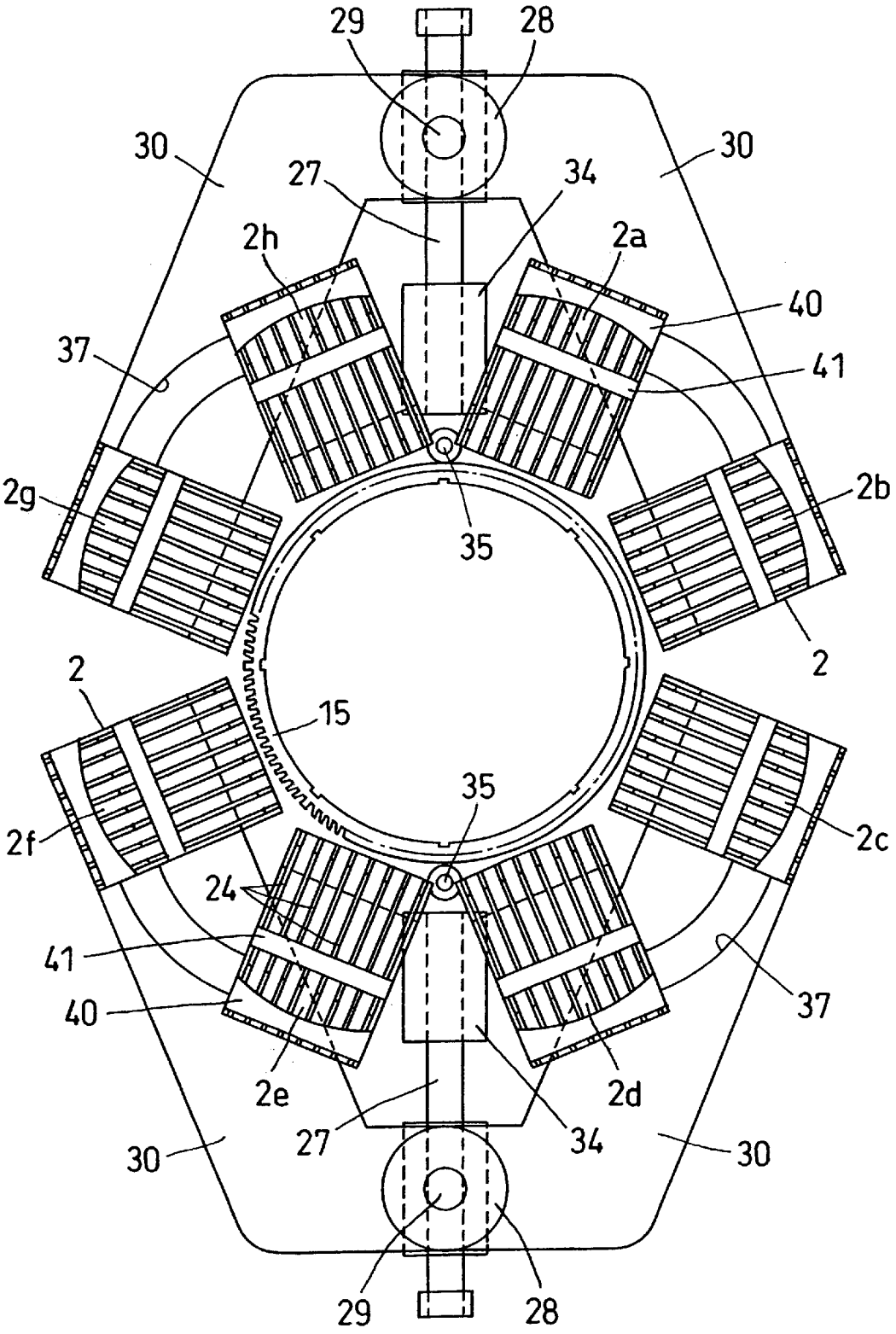
FIG. 16 is an enlarged plan view showing the transfer needles equipped movable tables arranged in a circular position in the sock transfer mechanism.

When the retracting action of the air cylinders 26 drives the transfer needles 24 to move back from their arcuate position shown in FIG. 13, the vacuum pipe 18 and the guide ring 15 are then lifted up to their no-action position shown in FIG. 14. As the transfer needles equipped movable tables 2*a* to 2*h* are shifted from the circular position and moved towards the axis of the cylinder 4, they are aligned in two rows as stay in the linear position as shown in FIGS. 15 and 20. With the two rows of the transfer needles equipped movable tables 2 aligned opposite to each other, the sock pattern of knitted fabric A is sandwiched at its toe portion between the two rows of the transfer needles equipped movable tables 2 as best shown in FIG. 15. The selvedge at the toe portion remains of the sock pattern held by the tips 38 of the transfer needles 24, shown in FIG. 25, under the transfer needles equipped movable tables 2.

While the sock pattern of knitted fabric A is sandwiched at its two portion between the two rows of the transfer needles equipped movable tables 2*a* to 2*h*, the base plate 11 of the sock transfer mechanism 3 is turned about the support post 10 to depart from the sock knitting machine 1. As the base plate 11 turns, the two portion of the sock pattern of knitted fabric A sandwiched between the two rows of the transfer needles equipped movable tables 2 is conveyed to a position just above the sewing machine. The selvedge at the toe portion of the sock pattern is then automatically sewed up with the sewing machine while held by the tips 38 of the transfer needles 24 beneath the transfer needles equipped movable tables 2.

Figure 27:
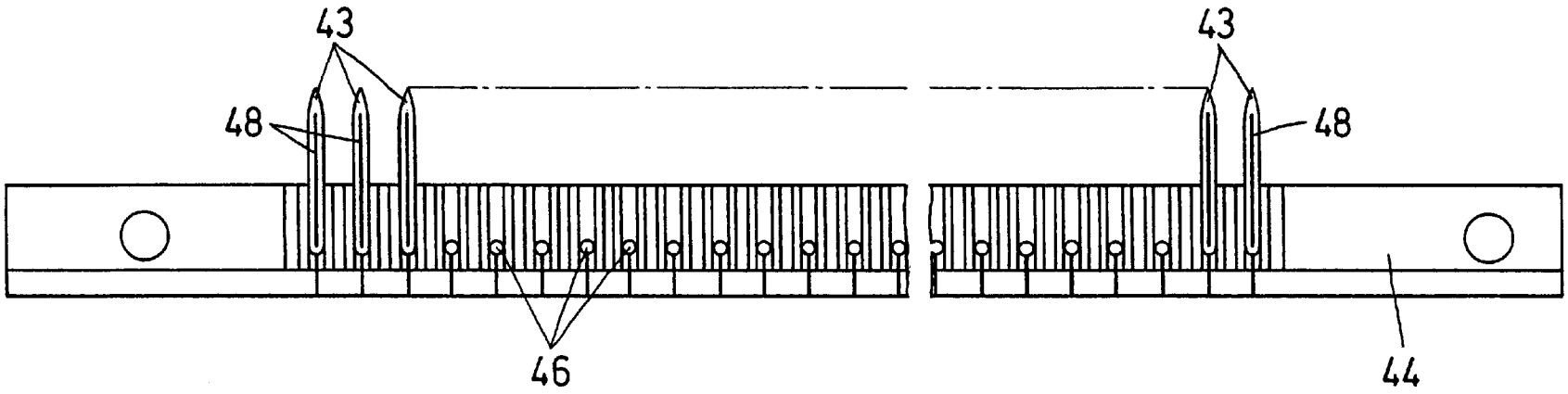
FIG. 27 is a plan view of a point needle holder bed.

For sewing up the selvedge at the toe portion of the sock pattern of knitted fabric, the embodiment has a point needle bed 44 on which a plurality of point needles 43 are aligned at equal intervals of a distance as shown in FIG. 27. In action, the point needles 43 are advanced into the corresponding loops a of the sock pattern of knitted fabric A held by the tips 38*a* of the transfer needles 24 before lifted upward.

Figure 28:
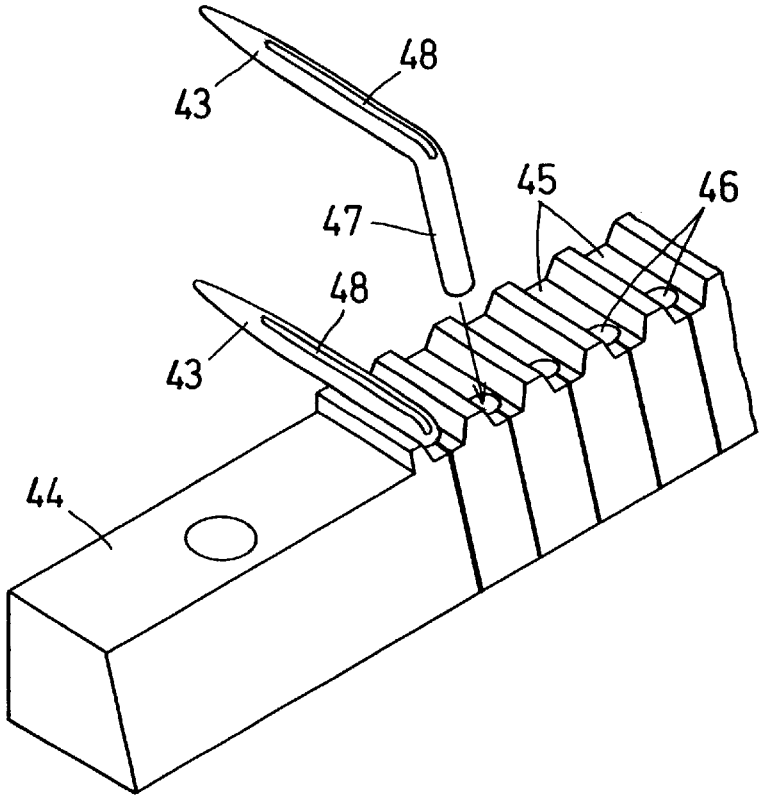
FIGS. 28A, 28B, and 28C are a perspective view showing a primary part of the point needle holder bed with point needles, a perspective view of the point needle, and a cross sectional view of the point needle respectively.
Figure 28:
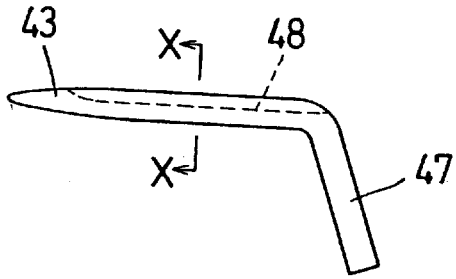
Figure 28:
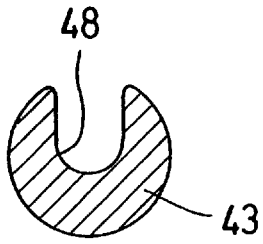

More particularly, each the point needle 43 is mounted to the holder bed 44 with its proximal end 47 inserted into a hole 46 provided at a recess 45 of the holder bed 44 as shown in FIG. 28A.

The point needles 43 has a longitudinal recess 48 provided in the upper side thereof.

Figure 29:
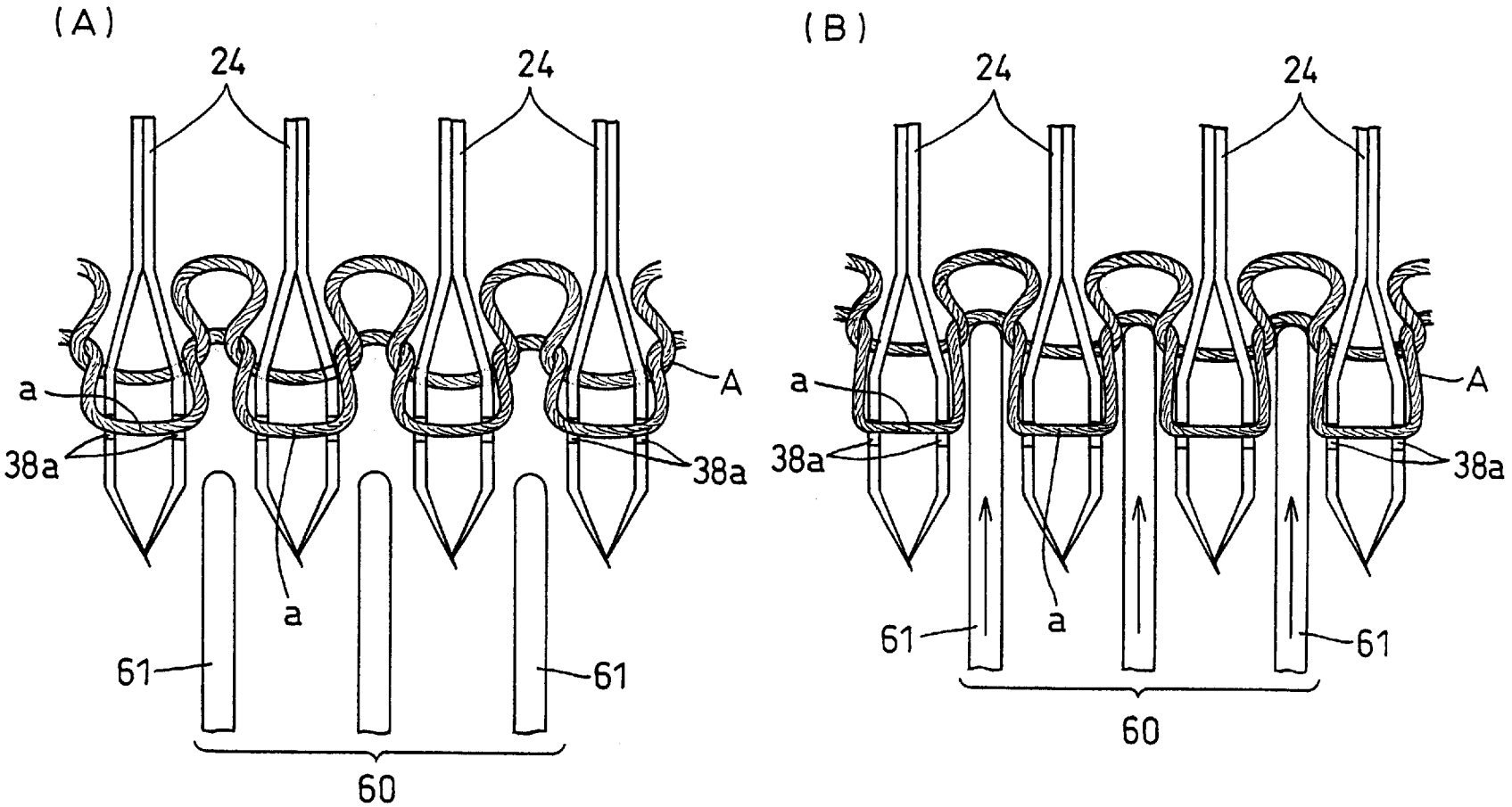
FIGS. 29A and 29B are a front view showing lifting strips before inserted between the transfer needles and a front view showing the lifting strips inserted between the transfer needles respectively.

Before the point needles 43 are advanced into the corresponding loops a of the sock pattern of knitted fabric A, the loops a are enlarged with a lifting member 60 shown in FIGS. 29A and 29B for ease of insertion of the point needles 43 into the corresponding loops a.

The lifting member 60 comprises a row of lifting strips 61 made of planer members. The lifting strips 61 are linearly alighted at equal intervals of the distance identical to that of the transfer needles 24 or the point needles 43 shown in FIG. 28. More specifically, the lifting strips 61 are aligned alternating with the transfer needles 24.

As the lifting member 60 is moved forward and backward and lifted upward and downward by a proper means, its lifting strips 61 are shifted from the position shown in FIG. 29A to the position shown in FIG. 28B so that each lifting strip 61 comes between any two adjacent transfer needle 24. Then, each portion between two loops a of the sock pattern of knitted fabric A is lifted up by the lifting strip 61, hence causing the loops a to be enlarged while held by the tips 38*a* of the corresponding transfer needles 24.

This allows the point needles 43 to advance without difficulty into the corresponding loops a of the sock pattern of knitted fabric A which are kept enlarged with the lifting strips 61. Also, as the loops a are enlarged uniformly, they can be sewed up without generating irregular stitches.

After the point needles 43 are advanced into the corresponding loops a, the lifting member 60 is lowered down from the point needles 43 and the transfer needles 24 and then its lifting strips 61 are withdrawn from the transfer needles 24.

As the loops a of the sock pattern of knitted fabric A held on the tips 38 of the transfer needles 24 are caught and lifted down slightly by the corresponding point needles 43 aligned at equal intervals on the holder bed 44 shown in FIG. 27, they are favorably maintained at equal intervals.

Figure 30:
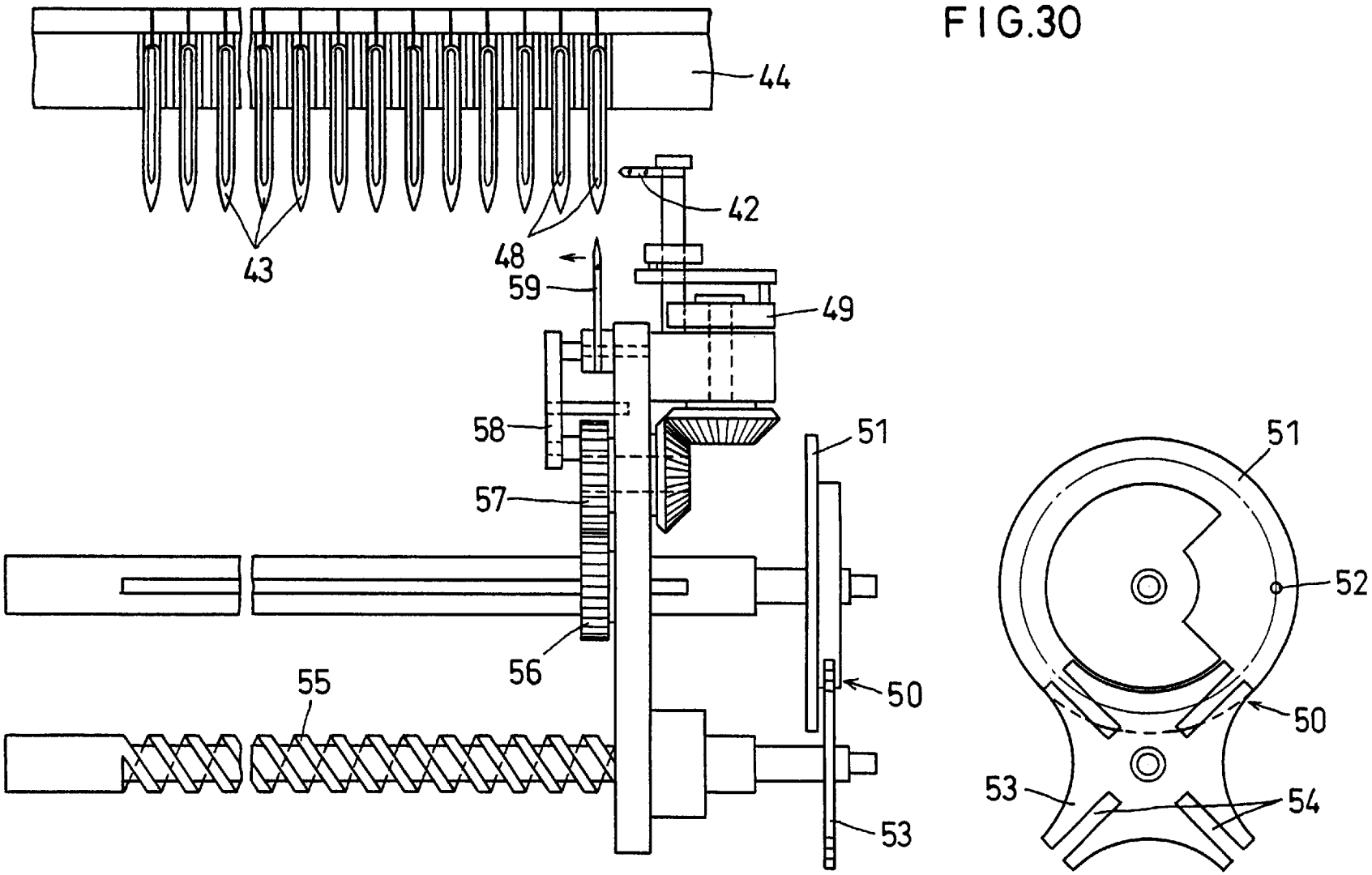
FIG. 30 is a plan view showing a primary part of a sewing machine for sewing up the loops at the toe portion of the sock pattern.
Figure 31:
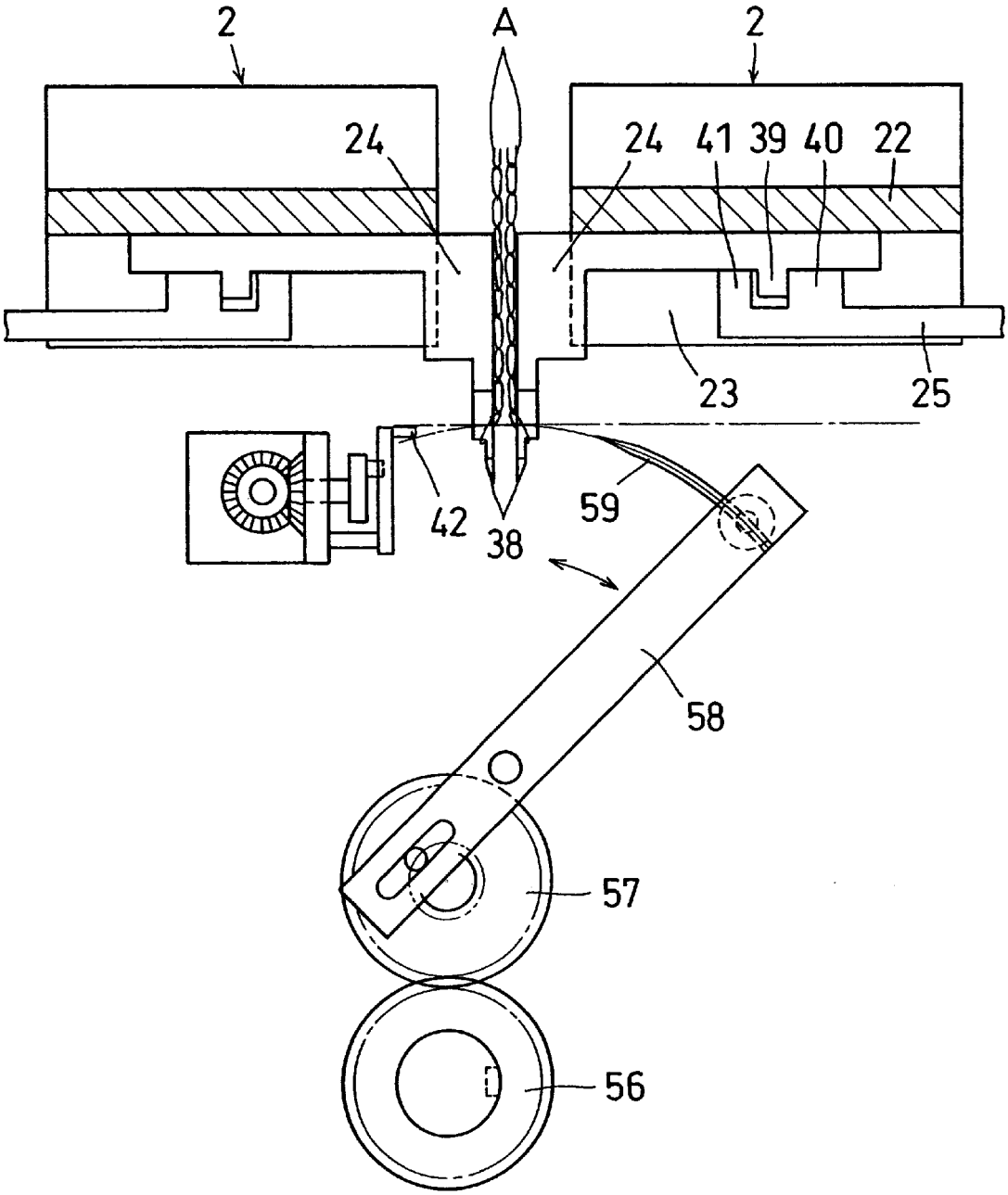
FIG. 31 is a side view showing a primary part of the sewing machine.

The loops a of the sock pattern of knitted fabric A are then sewed up with the sewing machine 49 which, as shown in FIGS. 30 and 31, includes a geneva mechanism 50 mounted at one end thereof where a follower wheel 53 remains static while a pin 52 mounted on a driver pin wheel 51 is disengaged from any of four slots 54 provided in the follower wheel 53.

In action, as the driver pin wheel 51 makes one full turn, the geneva mechanism 50 is turned ¼ thus providing a ¼ pitch intermittent movement of a screw shaft 55.

Also, the as the driver pin wheel 51 turns, a pair of gears 56 and 57 are actuated thus to drive the sewing needle 59 mounted to a rod 58 for intermittent reciprocal motions.

Because of both the movements, when the sewing needle 59 is advanced by the action of the paired gears 56 and 57 into the loop a held on the transfer needle 24, the pin 52 of the driver pin wheel 51 is not engaged with any slot 54 of the follower wheel 53 in the geneva mechanism 50, thus allowing the screw shaft 55 to remain not turned to hold the sewing machine 49 at the original position.

The loops a of the sock pattern of knitted fabric A are held at equal intervals by the action of the point needles 43 and can thus be sewed up precisely by the intermittent reciprocal action of the sewing needle 59 in and along the longitudinal recess 48 of each point needle 43.

The lateral movement of the sewing needles 59 is made by the driver wheel 51, of which the pin 52 is engaged with the slot 54 of the follower wheel 53 when the sewing needle 59 is retracted by the action of the gears 56 and 57, turning ¼ with its pin 52 departing from the slot 54 of the follower wheel 53 which also turns ¼. This causes the screw shaft 55 to turn and drive the sewing needle 59 of the sewing machine 49 to the position of the next point needle 43 for sewing up the loop a on the next point needle 43.

As the selvedge of the sock pattern of knitted fabric A has been sewed up with the sewing machine, the blower of the vacuum pipe 18 is switched off and the transfer needles equipped movable table 2 are returned back to the circular position. A finished sock is then removed from the sock transfer mechanism 3 and one cycle of sewing up the toe portion of the sock pattern of knitted fabric A is completed. Then, the apparatus is shifted back to above the sock knitting machine 1 and a next cycle of the action is commenced with the latch ring lowered for knitting another sock pattern of knitted fabric.

A feeder for feeding the toe sewing apparatus with a length of thread is provided where the thread is tensioned at a constant force with a tensioner so that it can hardly be loosened or entangled while being fed.

When the feeding of the thread is temporarily canceled for maintenance or other actions, the distance between the tensioner and the entrance of the sewing apparatus may be varied hence causing the thread to be loosened or entangled with neighbor threads. If worse, the thread may be cut off or fed at its entangled state, hence creating a downtime of the system. For compensation, a thread looseness eliminating device is preferably provided between the tensioner and the sewing apparatus.

Figure 32:
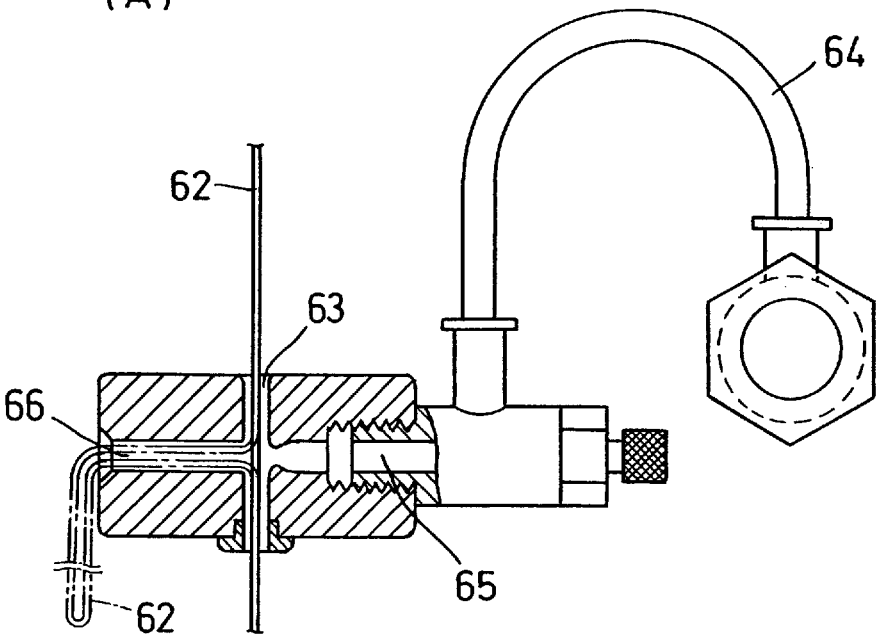
FIGS. 32A and 32B are an internal cross sectional view and a perspective view of a thread looseness eliminating device.
Figure 32:
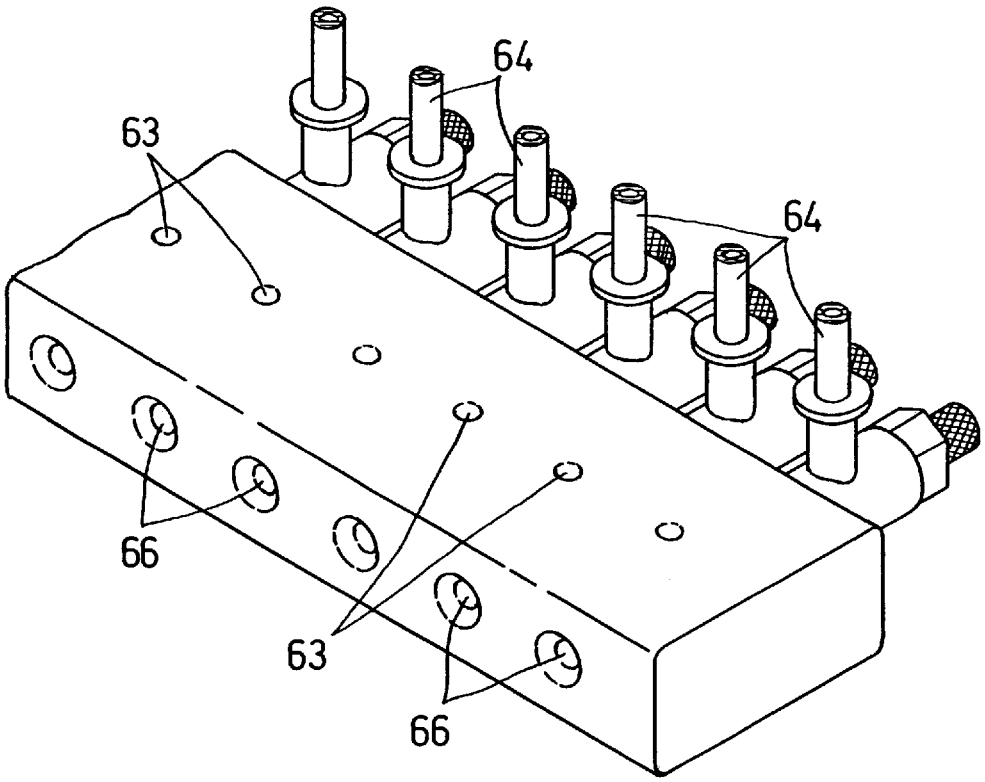

FIGS. 32A and 32B are an internal cross sectional view and a perspective view of the thread looseness eliminating device. A thread 62 is introduced from above across a through hole 63 in the looseness eliminating device to the toe sewing apparatus installed beneath. In common, the thread 62 is balanced between a drawing strength of the toe sewing apparatus and a tension strength of the tensioner and can thus be fed without looseness into the toe sewing apparatus.

When the feeding of the thread is temporarily canceled for maintenance or other actions and the toe sewing apparatus is dislocated for the actions, the through hole 63 is filled with a jet of air generated by an air pump, conveyed through an air pipe 64, and introduced from an air outlet 65. Accordingly, when a loosened portion of the thread 62 is created by the distance between the tensioner and the entrance of the toe sewing apparatus dislocated being shortened, it may be blown and forced by a jet of air out from an aperture 66 provided opposite to the air inlet 65. The loosened portion of the thread 62 hangs down from the aperture 66 due to its force of gravity as denoted by the one-dot chain line in FIG. 32A and can be inhibited from being entangled with other portions.

After the maintenance or other actions are finished, the toe sewing apparatus is returned back to its original position and the loosened portion of the thread 62 is then retracted from the aperture 66 to the through hole 63. As the thread 62 is fed straight across the through hole 63 to the toe sewing apparatus, the procedure of sewing up the selvedge of a sock pattern of knitted fabric can be restarted.

As set forth above, a sock pattern of knitted fabric fabricated by the sock knitting machine is lifted up and turned inside out by the suction from above. Then, the loops at the toe portion of the sock pattern of knitted fabric are transferred from the sock knitting machine to the transfer needled equipped movable tables which are in turn shifted from the circular position to the linear position. As the loops at the toe portion of the sock pattern of knitted fabric is held straight or flat between the two rows of the transfer needled equipped movable tables, they are conveyed to the toe sewing station by the movement of the transfer needled equipped movable tables and automatically sew up with the sewing machine. Since the sock pattern of knitted fabric fabricated by the sock knitting machine is automatically conveyed out from the sock knitting machine and sewed up at its toe portion, i.e. the procedure from knitting of the sock pattern to sewing up of the selvedge at the toe portion is automated, the production of quality socks will be improved in both the efficiency and the energy saving hence contributing to the cost down of the socks.

Also, the sock pattern of knitted fabric is turned inside out and held linearly at its toe portion and its selvedge at the toe portion can correctly be sewed up with the sewing machine.

Moreover, before the sewing up of the selvedge at the toe portion, the sock pattern of knitted fabric is lifted up by the action of the lifting member so that its loops at the toe portion can readily be transferred from the transfer needles to the corresponding point needles.

What is claimed is:

1. A method of sewing the toe of a sock comprising the steps of:

after knitting a sock pattern with a sock knitting machine, holding the knitting needles at a specific height, downwardly removing loops at the toe portion of the sock pattern of knitted fabric from latches of the corresponding knitting needles, and holding the loops at a specific location;

positioning a group of transfer needles equipped movable tables in a circular relationship just above the sock knitting machine;

setting the transfer needles on the transfer needles equipped movable tables close to the hooks of the knitting needles;

lifting up the sock pattern of knitted fabric to turn inside out and transfer the sock pattern at the loops of the toe portion from the knitting needles to the corresponding transfer needles with the help of a transfer bit elevated so that the sock pattern of knitted fabric turned inside out is transferred from the sock knitting machine to the transfer needles equipped movable tables;

positioning the transfer needles equipped movable tables in two linear rows aligned opposite to each other to sandwich the toe portion of the sock pattern of knitted fabric flatly from both sides;

shifting the transfer needles equipped movable tables to a toe sewing location; and automatically sewing up the toe portion of the sock pattern of knitted fabric with a sewing machine provided at the toe sewing location.

2. The method of sewing the toe of a sock according to claim 1, further comprising, when the sock pattern of knitted fabric is held by the transfer needles at the toe sewing location, lifting up the sock pattern of knitted fabric with a lifting member to enlarge its loops at the toe portion, inserting a plurality of point needles, each having a recess provided on the upper side thereof, into the corresponding loops which are enlarged, removing the lifting bit from the transfer needles, and sewing up the loops at the toe portion with a sewing needles which performs an intermittent reciprocal action in and along the recess of each point needles.

3. An apparatus for sewing the toe of a sock comprising:

a group of transfer needles equipped movable tables arranged movable for shifting between a circular position and a linear position where two linear rows come opposite to each other, moving up and down just above a sock knitting machine, and traveling forward and backward horizontally of the sock knitting machine;

a plurality of transfer needles mounted on the transfer needles equipped movable tables for radial movement when the transfer needles equipped movable tables are arranged in the circular position;

a guide ring for moving up and down in the center of a circle of the transfer needles equipped movable tables arranged in the circular position and when the transfer needles are advanced inwardly, holding the tips of the transfer needles in a circle so that the transfer needles come close to hooks of a corresponding knitting needles of the sock knitting machine;

a vacuum pipe for moving up and down in the guide ring and when held at a lower position, drawing by suction from above a sock pattern of knitted fabric fabricated by the sock knitting machine so that the sock pattern is turned inside out and lifted up; and a sewing machine installed at a location on a horizontal traveling path of the transfer needles equipped movable tables for sewing up the toe portion of the sock pattern.

4. The apparatus for sewing the toe of a sock according to claim 3, further comprising:

a lifting member for lifting up the sock pattern of knitted fabric held on the transfer needles at the location for sewing up the toe portion of the sock pattern;

a plurality of point needles, each point needle having a recess provided in the upper side thereof, for moving to and from the corresponding loops of the sock pattern of knitted fabric held on the transfer needles; and a sewing needle for performing an intermittent reciprocal action in and along the recess of each point needles which holds one of the loops so that the loops at the toe portion of the sock pattern of knitted fabric can be sewed up.

* * * * *